US008256497B2

(12) United States Patent
Gietzen

(10) Patent No.: US 8,256,497 B2
(45) Date of Patent: Sep. 4, 2012

(54) THERMAL ENERGY EXCHANGER

(76) Inventor: John Gietzen, Holland, MI (US)

( * ) Notice: Subject to any disclaimer, the term of this patent is extended or adjusted under 35 U.S.C. 154(b) by 119 days.

(21) Appl. No.: 12/696,597

(22) Filed: Jan. 29, 2010

(65) Prior Publication Data

US 2010/0186927 A1 Jul. 29, 2010

Related U.S. Application Data

(63) Continuation of application No. 11/948,159, filed on Nov. 30, 2007, now abandoned, which is a continuation of application No. 11/800,287, filed on May 4, 2007, now abandoned.

(60) Provisional application No. 60/797,482, filed on May 4, 2006.

(51) Int. Cl.
*F24F 7/08* (2006.01)

(52) U.S. Cl. ..... 165/54; 165/76; 165/78; 165/46; 165/171; 165/905; 165/158; 165/178; 165/172; 165/173; 165/175

(58) Field of Classification Search ..... 165/54, 165/76, 173, 175, 178, 905, 78, 46, 171, 165/158, 172
See application file for complete search history.

(56) References Cited

U.S. PATENT DOCUMENTS

| | | | | |
|---|---|---|---|---|
| 3,277,959 | A | 10/1966 | Withers | |
| 3,280,903 | A | 10/1966 | Stoddard, Jr. | |
| 3,426,841 | A | 2/1969 | Johnson | |
| 3,435,893 | A | 4/1969 | Withers | |
| 3,438,423 | A | 4/1969 | Melull | |
| 3,459,622 | A | 8/1969 | Fisher | |
| 3,477,504 | A | 11/1969 | Colyer | |
| 3,489,209 | A | 1/1970 | Johnson | |
| 3,648,768 | A | 3/1972 | Scholl | |
| 3,905,850 | A | 9/1975 | Darm | |
| 3,995,688 | A | 12/1976 | Darm | |
| 4,032,391 | A | 6/1977 | Moked | |
| 4,049,404 | A | 9/1977 | Johnson | |
| 4,085,591 | A | 4/1978 | Bissell | |
| 4,137,023 | A | 1/1979 | Moked | |
| 4,147,206 | A | 4/1979 | Basiulis | |
| 4,187,675 | A | 2/1980 | Wakeman | |
| 4,206,805 | A | 6/1980 | Beckett | |
| 4,215,676 | A * | 8/1980 | Gilliam | 165/173 |
| 4,318,367 | A | 3/1982 | Antonucci | |
| 4,327,670 | A | 5/1982 | Teller | |
| 4,376,373 | A | 3/1983 | Weber | |
| 4,377,201 | A | 3/1983 | Kruse | |

(Continued)

FOREIGN PATENT DOCUMENTS

DE 4002560 A1 * 8/1991

(Continued)

*Primary Examiner* — John Ford
(74) *Attorney, Agent, or Firm* — Varnum, Riddering, Schmidt & Howlett LLP

(57) ABSTRACT

A thermal energy exchanger assembly (100) includes an exchanger housing (138). The exchanger housing (138) houses a pair of core support assemblies (174) formed of individual core supports (200). The core supports (200) are coupled together so as to form apertures 228. Core tubes (180) are received within the apertures (228). A fresh airstream (122) is made to flow through the core tubes (180) while a stale airstream (114) is made to flow between and around the core tubes (180). In this manner, an exchange of thermal energy occurs between the fresh airstream (122) and the stale airstream (114).

4 Claims, 28 Drawing Sheets

U.S. PATENT DOCUMENTS

| | | | | |
|---|---|---|---|---|
| 4,483,392 | A | | 11/1984 | Korsmo |
| 4,515,210 | A | | 5/1985 | Smith |
| 4,528,733 | A | * | 7/1985 | Lord ..... 165/905 |
| 4,554,719 | A | | 11/1985 | Lewis |
| D282,870 | S | | 3/1986 | Benning |
| 4,646,817 | A | | 3/1987 | Van Ee |
| 4,653,574 | A | | 3/1987 | Quinlisk |
| 4,653,575 | A | | 3/1987 | Courchesne |
| 4,708,197 | A | | 11/1987 | Robbins |
| 4,713,943 | A | | 12/1987 | Wainwright |
| 4,735,261 | A | * | 4/1988 | Huebner ..... 165/76 |
| 4,763,722 | A | | 8/1988 | Piazzola |
| 4,769,053 | A | | 9/1988 | Fischer, Jr. |
| 4,794,980 | A | | 1/1989 | Raisanen |
| 4,820,468 | A | | 4/1989 | Hartig |
| 4,913,222 | A | | 4/1990 | Cowan |
| 4,971,137 | A | | 11/1990 | Thompson |
| 4,993,484 | A | | 2/1991 | Neuzil |
| 5,107,924 | A | | 4/1992 | Herbert |
| D330,248 | S | | 10/1992 | Chagnot |
| 5,152,144 | A | | 10/1992 | Andrie |
| 5,201,024 | A | | 4/1993 | Steffes |
| 5,273,106 | A | | 12/1993 | Drake |
| 5,431,215 | A | | 7/1995 | Davis |
| 5,435,377 | A | | 7/1995 | Kratochvil |
| 5,458,187 | A | | 10/1995 | Davis |
| 5,497,823 | A | | 3/1996 | Davis |
| 5,660,228 | A | | 8/1997 | Steege |
| 5,771,707 | A | | 6/1998 | Lagace |
| 5,775,414 | A | | 7/1998 | Graham |
| 5,785,517 | A | | 7/1998 | Gray |
| 5,816,315 | A | | 10/1998 | Stark |
| 5,913,360 | A | | 6/1999 | Stark |
| 5,979,543 | A | | 11/1999 | Graham |
| 6,062,296 | A | | 5/2000 | Broberg |
| 6,094,816 | A | | 8/2000 | Doshi |
| 6,206,603 | B1 | | 3/2001 | Graham |
| 6,361,588 | B1 | | 3/2002 | Moratalla |
| 2002/0144807 | A1 | | 10/2002 | McCrorie, IV |
| 2002/0166657 | A1 | | 11/2002 | Uchison |
| 2003/0031904 | A1 | | 2/2003 | Haltiner, Jr. |
| 2003/0037909 | A1 | | 2/2003 | Smyrnov |
| 2003/0079872 | A1 | | 5/2003 | Bergevin |
| 2005/0103483 | A1 | | 5/2005 | Buhlmann |

FOREIGN PATENT DOCUMENTS

| | | |
|---|---|---|
| GB | 1261905 | 1/1972 |
| RU | 2071015 | 12/1996 |

* cited by examiner

THERMAL ENERGY EXCHANGER

CROSS-REFERENCE TO RELATED APPLICATIONS

This application is a continuation of U.S. patent application Ser. No. 11/948,159 filed on Nov. 30, 2007, now abandoned which is a continuation of U.S. patent application Ser. No. 11/800,287 filed on May 4, 2007, now abandoned which claims priority of and is based on U.S. Provisional Patent Application Ser. No. 60/797,482 filed May 4, 2006.

STATEMENT REGARDING FEDERALLY SPONSORED RESEARCH OR DEVELOPMENT

Not applicable.

REFERENCE TO A MICROFISHE APPENDIX

Not applicable.

BACKGROUND OF THE INVENTION

1. Field of the Invention

The invention relates to thermal energy exchangers and, more particularly, to thermal energy exchangers adapted primarily for use in residential, commercial and industrial interiors for exchange of energy between stale air and fresh air.

2. Background Art

The concept of employing thermal energy exchangers for various applications is relatively well known. For example, thermal energy exchangers are used in industrial facilities for insuring that interior air does not build up to a dangerous level of pollutants or toxicity. It is also becoming known to utilize thermal energy exchangers in residential and general commercial applications. For example, thermal energy exchangers serve very useful purposes in restaurant facilities, particularly around kitchen areas where various types of cooking functions are being undertaken.

It is also known to employ thermal energy exchangers in applications such as vehicles. For example, it is known to employ vehicle thermal energy exchangers having a series of plastic tubes. The tubes are arranged in a series of mutually parallel rows, with a pair of plastic collector plates connected to the ends of the tubes. However, manufacture of the collector plates in single pieces can exhibit certain problems. For example, the high precision collector plates may need to be stamped with a relatively large number of holes (i.e. 200 to 2000). These holes may be of relatively small diameter, namely on the order of 1.5 to 5 mm. It is difficult to undertake such stamping processes, particularly when it is also necessary to undertake periodic checks for shrinkage and deformation. Still further, the stamping process must be undertaken while avoiding the presence of molding/dripping into the holes. Also, manufacture of each collector plate in a single piece makes it difficult to automatically insert the ends of the tubes in the holes of the collector plates.

To overcome these drawbacks, it is also known to undertake activities where each collector plate is constructed from a number of plastic terminal elements. The plastic terminal elements are overlapped and welded together. Each of the terminal elements includes a series of semi-circular seats separated from each other by bonding portions, suitable for being welded to corresponding bonding portions of a complimentary terminal element. The assembly procedure for this type of thermal energy exchanger starts from a first pair of terminal elements, engaging the ends of a first row of tubes in the semi-circular seats of the terminal elements. A second pair of terminal elements are then positioned above the first row of tubes, and the bonded portions of the terminal elements are then welded together. This operational sequence may be repeated a number of times, in correspondence to the number of rows of tubes that form the finished thermal energy exchanger.

With this process, adjacent terminal elements may be bonded together by means of welding, ultrasonic or comparable processes. These processes can cause the bonding portions in reciprocal contact to melt together. Also, such welding operations are extremely delicate, and require accurate calibration of the welding parameters. For example, if too much material is fused, flash which is formed by the plastic material can enter the ends of the tubes, thereby causing perforations. In turn, these perforations can result in heat exchange fluid leakage in the finished thermal energy exchanger. In contrast, however, if the space between the abutting surfaces of the bonding portions of the terminal elements is not completely closed during welding, a hermetic seal between the ends of the tubes and the collector plate is not achieved. Accordingly, in this case as well as the prior, the finished thermal energy exchanger may have heat exchange fluid leaks.

An attempt to overcome certain of the foregoing problems is disclosed in Mannoni, et al, U.S. Patent Application Publication No. U.S. 2002/0157817 A1, published Oct. 31, 2002. For purposes of description, reference will be made to the reference numerals utilized in the disclosure of the Mannoni, et al, patent application publication. Therein, Mannoni, et al, disclose a plastic thermal energy exchanger 10. The thermal energy exchanger 10 includes a number of tubes 12 forming a heat exchange core. The tubes 12 can be characterized as being formed of thin plastic "straws" arranged in a series of mutually parallel rows. The ends of the tubes are bonded and sealed to a pair of collector plates 14. Two tanks 16 and 18 are then bonded to the respective collector plates 14. The tank 18 is equipped with openings 20, providing for the inlet and outlet of heat exchange fluid.

Each collector plate 14 can be characterized as being formed by a series of plastic terminal elements 22. Each terminal element includes a first and second row of semi-circular seats 24 and 26. The seats 24 and 26 are separated from each other by bonding portions 28 and 30. Each terminal element 22 is equipped with a pair of space elements 32. In final assembly, the pair of space elements 32 will rest against a surface 34 of an identical terminal element 22. Assembly can be undertaken utilizing single layers. Each layer can be realized by means of an operational sequence. The operational sequence includes the following functional steps:

a. Preparing a first terminal element 22a.
b. Placing the ends of a row of tubes 12 in the seats 26 of the first terminal element 22a.
c. Offering up a second terminal element 22b, such that the ends of the tubes 12 engage with the seats 24 of the second terminal element 22b.
d. Welding the bonding portions 28 and 30 of the first and second terminal elements 22a and 22b, respectively, together along the welding plane or surface 34.

For the Mannoni, et al, assembly, the welding plane or surface 34 represents or can be characterized as an "ideal" joint plane, allowing the semi-circular seats 24 and 38 which face each other to be united together. This assembly results in a formation of circular seats, with a diameter equal to that of the external diameter of the ends of the tubes 12.

Mannoni, et al, then go on to illustrate views of the two complimentary bonding portions 28, 30 which are to be bonded together by means of the welding process. Each bonding portion 28 of the terminal element 22a can be characterized as a butt surface 36, set back with respect to the welding plane 34. The volume between the welding plane 34 and the butt surfaces 36 of the terminal element 22a can be characterized as Va. Each bonding portion 30 of the terminal element 22b has a welding portion 38. The welding portion 38 projects beyond the welding plane 34. The volume of material of each bonding portion 30 projecting beyond the welding plane 34 is characterized as Vb. Mannoni, et al, then further disclose the concept that a "fill ratio" R can be defined as the ratio between the volumes Va and Vb. Mannoni, et al, then further describe the concept that the fill ration R would be in the range, for their embodiment, of 0.8 to 1.3.

Mannoni, et al, further describe and illustrate a bonding zone between the bonding portions 28, 30, after completion of welding. Mannoni, et al, further explain that the fact of having a fill ratio which is relatively close to unity allows the volume Va to be filled with material originating from the melting of volume Vb. Mannoni, et al, characterize this fact as permitting a substantially ideal bond between the terminal elements 22a and 22b. Mannoni, et al, also describe the concept that, in particular, problems of excess molten material occluding the ends of the tubes that are not completely sealed due to an insufficient amount of molten material, are avoided. To better describe this concept, Mannoni, et al, illustrate and describe a situation following a welding operation with a fill ratio that is considered to be too high. That is, the fill ratio is in excess of 1.3. In such a case, the excess molten material will exude laterally from the reciprocal mating surfaces of the bonding portions, and thus invade the spaces of the tubes. Such molten material may damage the walls of the tubes and cause heat exchange fluid leaks.

In contrast, Mannoni, et al, also describe the concept where the fill ratio is considered to be too low. That is, the fill ratio is less than 0.8. In this situation, the material that is welded is insufficient to fill the space between the butt surfaces of the bonding portions, thus giving rise to openings that can cause heat exchange fluid leaks by means of the collector plate.

As with Mannoni, et al, and other heat exchange assembly processes for plastic tube exchangers, full plates are utilized, with holes required for the insertion of the tubes through the holes. The holes are then sealed with either a heated wire, glue or the like. This is considered to be an extremely slow and labor intensive process. Accordingly, it would be advantageous if a design utilized for the end plate would be made of preformed inserts, allow for the tubes to be quickly assembled and then sealed with, for example, compression processes.

Various other types of systems employing heat exchanging concepts have been developed and are known in the industry. For example, Stark, U.S. Pat. No. 6,182,747 issued Feb. 6, 2001 discloses an air-to-air heat exchanging system utilizing a first airstream and a second airstream. The system includes at least two air-to-air thermal energy exchangers, with each having heat conducting walls, secured to a frame. The system can be characterized as having crossflow thermal energy exchangers with a series of parallel channels alternately blocked and enclosed within a housing. In this manner, one airstream is forced to be directed through the exhaust air channels, and a second airstream is directed through the supply air channels. This occurs in a substantially crossflow arrangement, and can further be characterized as a plate-type thermal energy exchanger system. In addition to the foregoing, the Stark system includes arrangement of a number of the thermal energy exchanger units in a side-by-side configuration, with a manifold for purposes of dispersing and gathering the related airstreams to a plenum chamber, so as to reduce the size of the system and the energy requirements for operating the system for conditioning a large volume of air.

Stark further describes what he considers to be prior art to his own thermal energy exchanger system. For example, Stark describes the concept that a number of different devices that exchange heat between airstreams are relatively well known, whereby stale air is exhausted from a building source as an energy source for heating or cooling incoming outside air.

Stark further describes the concept that there currently exists a number of crossflow plate-type air-to-air thermal energy exchangers. These known devices can be constructed of plastic or metal for heat exchange or alternatively, can be constructed of a homogenous material (such as paper) for a latent energy exchange. In the prior art thermal energy exchangers, Stark describes the concept that a large space is generally required, for purposes of housing the large plate crossflow thermal energy exchangers. As plates of a plate thermal energy exchanger increase in size, and for a given efficiency, the space in between the plates must increase in distance. Correspondingly, such increase in plate spacing results in a significant increase in the entirety of the volume of the heat exchanging apparatus.

Stark further explains that volumetric efficiency quantifies as the required equipment volume in a "per unit of capacity" at a given performance level. In plate-type crossflow air-to-air thermal energy exchangers, and for purposes of increase in the volume efficiency and economy of the unit, the smallest possible plate size should preferably be used. However, crossflow thermal energy exchangers with smaller plates generally require additional length (i.e., additional plates) for handling air volumes equal to those of units having larger plates. However, increase in the plate size will require a relatively larger installation space, which may then limit the performance of the thermal energy exchanger. Also, when using crossflow plate-type air-to-air thermal energy exchangers with smaller plates, the length, or number of plates, typically exceeds the allowable dimensions or number of plates.

In the Stark system, certain of the disadvantages associated with systems known prior to Stark are allegedly obviated. More specifically, Stark describes the concept of providing a plate-type crossbow air-to-air thermal energy exchanger with a series of plates, while maintaining a seal between the intake channel and exhaust channels. Stark also describes the concept that the thermal energy exchanger facilitates installation in a system which utilizes a relatively small number of units, so as to reduce the size required for installation, while correspondingly providing a relatively efficient operating and economical system for recovering heat in buildings, such as homes and offices.

In summary, the apparatus described in Stark can be utilized as a thermal energy exchanger, where intake air is heated or cooled in a plate thermal energy exchanger, using the heat energy in the exhaust air. The exhaust air flow travels through the exhaust channel, of which at least one wall of the channel represents the wall separating the intake channel from the exhaust channel. It is through this wall that the heat exchange process occurs.

A series of conducting walls are arranged face to face, and then also arranged in a side-by-side configuration, in rows so as to complete the necessary amount of heat exchange space. The number of intake and exhaust channels is determined by the amount of plates provided, which is variable with respect to the installation. Stark describes the concept that a square shape for the thermal energy exchanger is preferably positioned on a point of the square, so that a diagonal running from one corner of the square to its opposite corner is generally vertical when the unit is installed.

The thermal energy exchanger plates are disclosed as being spaced apart by a series of corrugations extending between the walls and in thermal contact with each of the walls. The corrugations serve the dual purpose of enhancing heat transfer between the walls, and also providing flow paths for the airstream to seal the intake channels from the exhaust channels. Stark describes the concept of the preferred arrangement as a crossflow, where the air path and intake channels are arranged at right angles to the air path and exhaust channels. In this manner, the flow path through the heat conducting walls is defined so that the intake air flow is substantially in a crossflow arrangement from the exhaust air flow. Stark also discloses the concept that the Stark configuration may use two manifolds, consisting of entrance and exit ports for the intake airstream and entrance and exit ports for the exhaust airstream. The flow pattern through the apparatus is considered to be a function of how the manifolds are baffled in relation to one another. The flow pattern may be arranged for either crossflow or parallel flow.

Thunberg, U.S. Pat. No. 4,391,321 issued Jul. 5, 1983 discloses another thermal energy exchanger for use in ventilating interior structures. The thermal energy exchanger is utilized in combination with a two duct system, for bringing relatively cold outside air into an enclosure, while exhausting relatively warm room air from the enclosure. The thermal energy exchanger is positioned so as to recover heat from the exhaust air into the incoming cold fresh air. Specifically, Thunberg discloses the concept of employing a valving system which switches the incoming cold air with the warm exhaust air in the flow paths of the thermal energy exchanger. Thunberg describes the concept that this valving configuration allegedly solves the problem of moisture from the exhaust air condensing on the walls of the ducting system for the exhaust air.

Martin, et. al., U.S. Pat. No. 4,336,748 issued Jun. 29, 1982 discloses an exchanger for exchanging a first fluid with a second fluid, in varying proportions. A first duct carries the first fluid, while a second duct carries the second fluid. A transfer chamber is connected to both ducts through which some or all of the second fluid is able to be transferred back into the first duct. A variable control system is provided in the form of first and second damper blades in the chamber which can be swung together, thus dividing the chamber and preventing transfer. The blades can correspondingly be swung apart so as to provide for varying proportions of the transfer. The chamber also has an inlet means for inlet of the first fluid, and outlet means for discharges of the second fluid.

Goldsmith, U.S. Pat. No. 3,934,798 discloses a heat exchanging system for use with a forced draft home heating system. Air is directed from a return register to the return plenum through a thermal energy exchanger interposed in the line of the flue. The thermal energy exchanger includes an enlarged casing extending between tapered collars, and enclosing heat exchange tubes having approximately the same cross sectional area as the flue.

George, U.S. Pat. No. 4,334,577 issued Jun. 15, 1982 discloses a ventilation system for a livestock house. The system includes a thermal energy exchanger whereby, prior to entering the thermal energy exchanger, warm moist air from the interior passes through a filter device that removes particulates. In this manner, the particulates do not combine with condensation in the thermal energy exchanger, so as to block the thermal energy exchanger. Fresh air, received from the outside, and after being warmed in the thermal energy exchanger, passes into an elongated distribution plenum located slightly below the ceiling of the livestock house. This plenum contains apertures which direct the fresh air horizontally into the housing area. The upper surface of the plenum is located directly below an elongated opening in the ceiling. Along each side of the opening, baffles are hinged to the ceiling. The baffles extend obliquely outwardly and downwardly, and contact the upper surface of the plenum at their lowermost edges. With this configuration, warm moist air from the building is prevented from escaping through the opening and into an attic area above the ceiling. However, when exhaust fans are energized to exhaust air from the living area, the withdrawn air is replaced by air from the attic. This air is passed into the living area by lifting the baffles and flowing outwardly over the horizontal upper surface of the plenum.

With an appropriate accommodation of tube designs and core plate designs, assembly speed can not only be facilitated, but other problems can also be overcome. For example, it would be advantageous to have the capability of eliminating the need for defrosting units in cold weather. If this problem could be eliminated, it would greatly reduce the overall cost of plastic tube exchanges, compared to other types of thermal energy exchangers on the market. Elimination of the defrost cycle and related parts would allow for the use of all plastic housing and axial fan components. Accordingly, an "all plastic" thermal energy exchanger or "heat recovery ventilator" ("HRV") could be made available. Such a thermal energy exchanger would have numerous advantages. For example, one of the by-products of air-to-air heat exchange is condensation on the inside of housing and tubes. With metal housings, units are subjected to rust, eventually resulting in the mixing of the airstreams and ultimate failure of the HRV unit. With an all plastic assembly, the longevity of the HRV or thermal energy exchanger is increased, due to the elimination of components subject to rust.

Another aspect of air-to-air thermal energy exchanger assemblies is that the longer the air can stay within the core, the "more efficient" the actual exchange will function. In this regard, it would be advantageous to have some type of assembly or design which would improve exchange rates between the two airstreams. Another aspect of providing for more efficient exchange of thermal energy relates to surface areas of surfaces which separate fresh airstreams from stale airstreams. That is, the greater the surface area of the material which separates the stale airstream from the fresh airstream, the higher will be the flow rate of thermal energy between the airstreams.

In addition, it would also be advantageous to undertake tube designs which will improve relative cleanliness. Known plate core designs accumulate dirt and dust particles, which eventually plug up the core and reduce exchange efficiency and air flow. Such known thermal energy exchangers are then relatively difficult to clean, because such cleaning requires the disassembly of the unit periodically so as to maintain efficiency. In this regard, it would be advantageous to utilize a tube design which reduces the frequency of necessary cleaning, and also facilitates cleaning when required.

In accordance with all the foregoing, it would be advantageous to utilize a core end plate and tube design which facilitates assembly, runs efficiently, and is of a relatively low cost. In this regard, it would be advantageous for such a thermal energy exchanger to have relatively few moving parts, and not be susceptible to wear, such as rust processes.

In accordance with the foregoing, it is advantageous to provide for a thermal energy exchanger meeting these advantages. In this regard, and with reference to the core, a thin wall plastic tube may utilize "film heat transfer" technology, so as to pass heat from one airstream to another, without mixing the air at a rate comparable to that of aluminum. Such a tube design has advantages over other plastic cores on the market, because it provides for a greater surface area than current plate technology. Also, due to the internal diameter of the tube, it will reject "freeze-up" in cold weather, which require defrosting cycles.

More specifically, with the use of plastic tubes having relatively thin walls, the internal diameter of each tube is relatively larger than would exist with tubes having relatively thicker walls. Still further, if the tubes can be supported and constructed so as to provide for additional and larger spaces between and around the tubes, freeze-up can again be significantly reduced. This feature can result in financial savings not only in that fewer or no defrosting cycles are required, but also that the use of a fan may not be required whatsoever.

With respect to the end plates, it is advantageous to utilize a design where the end plate is made up of preformed inserts, allowing for the tubes to be quickly assembled and sealed with compression. Such a design will work with current plastic tubes, and with enthalpic tubes known to be utilized for energy recovery ventilators, as well as metal tubes such as copper or aluminum without design changes to the overall unit.

SUMMARY OF THE INVENTION

In accordance with the invention, a thermal energy exchanger assembly is adapted for use with building interiors, for exchange of energy between fresh air and stale air. The energy exchanger includes an exchanger housing, along with a fresh airstream incoming means which is coupled to the exchanger housing for receiving an incoming fresh airstream and guiding the incoming fresh airstream to the exchanger housing. A stale airstream incoming means is also included, and is coupled to the exchanger housing for receiving an incoming stale airstream from a building interior, and guiding the stale incoming airstream into the exchanger housing.

The energy exchanger also includes a pair of core support assemblies. The pair of assemblies includes a first core support assembly and a second core support assembly. Each of the core support assemblies includes a series of core supports coupled together and defining a series of core tube apertures therein. In addition, the exchanger includes at least one tube assembly extending between the pair of core support assemblies. The tube assembly includes a number of core tubes. Each of the core tubes includes first and second ends. The first ends of the core tubes are received within the apertures of the first core support assembly, while the second ends of the core tubes are received within the series of apertures of the second core support assembly.

The incoming fresh airstream flows into the series of core tubes, and the incoming stale airstream flows in between and around the core tubes. The core tubes are sized, structured and manufactured of appropriate materials so that an exchange of thermal energy occurs between the incoming fresh airstream within the core tubes and the incoming stale airstream flowing between and around the core tubes.

In accordance with other aspects of the invention, each of the core tubes is supported in space only at its respective first and second ends, and only by the first core support assembly supporting the first end, and the second core support assembly supporting the second end. Each of the core supports can be substantially identical in size and structure to all others of the series of core supports. Further, each of the core support assemblies can be assembled through the use of the series of core supports in the absence of any requirement for tooling. In this regard, each of the core support assemblies is assembled through coupling together immediately adjacent core supports, with each pair of the immediately adjacent core supports forming a certain set of the series of apertures therein. The core tubes of the tube assembly are coupled into and received within corresponding ones of the apertures simultaneously with the assembly of the core support assemblies from the series of core supports.

Each of the core tubes can be characterized as having an outer diameter. Each of the series of apertures defined with assemblies of the series of core supports into the pair of core support assemblies can be characterized as having an inner diameter. The outer diameters of the core tubes are constructed so as to be slightly larger than the inner diameters of the apertures formed within the core support assemblies. As a result of the outer diameters of the core tubes being slightly larger than the inner diameters of the apertures, the core tubes are provided with a compression fit when assembled into the apertures of the core support assemblies. Further, the series of core supports are sized and constructed so that adjacently positioned ones of the core supports of one of the core support assemblies are coupled together, without requiring welding or any other permanent connecting means.

In accordance with another aspect of the invention, the energy exchanger assembly is operable in cold weather, in the absence of any need for defrosting apparatus. Further, the entirety of the thermal energy exchanger assembly has an absence of any metallic components. In this regard, the series of core tubes consists of thin wall plastic tubes. Each of the core tubes is sized and constructed so as to utilize thin film heat transfer technology.

In accordance with further aspects of the invention, when the tube assembly is coupled into the core support assemblies, each of the core tubes is spaced separate and apart from adjacent core tubes, and none of the core tubes abut any of the adjacent core tubes.

In accordance with still further characteristics of the invention, the exchanger operates at an efficient level, in the absence of any requirement of any fan or other components to physically force the incoming fresh airstream into the core tubes, or to physically force the incoming stale airstream around and in between the core tubes. With respect to another aspect of the invention, the energy exchanger assembly includes an air filter positioned adjacent and in front of ends of the core tubes, through which the incoming fresh airstream enters the core tubes.

Other concepts of the invention include the concept that each of the core supports forming the core support assemblies is preformed and substantially identical to each of the other core supports. The core tubes can each be constructed of a polypropylene material. Still further, each of the core supports can be constructed of an ABS material. Also, the energy exchanger assembly can include means open to an interior of the exchanger housing between the core support assemblies, for draining water which may have formed as condensed moisture as a result of heat being removed from the incoming stale airstream.

In accordance with a further concept of the invention, when each of the pair of core support assemblies is assembled, each of the assemblies forms a honeycomb configuration, and the honeycomb configuration further forms the apertures as a series of annular configurations. Further, each of the core supports includes a series of coupling sections, with each coupling section being identical to each of the others of the coupling sections, and formed along an elongated portion of the core support. In this regard, each of the core supports is characterized as having a top side and a bottom side. Each coupling section includes a series of cylinder halves, with a pair of first cylinder halves located on the top side of the coupling section, and with each of the first cylinder halves providing half of an inner surface of the apertures, within which the core tubes will be received. Also, the series of cylinder halves further consists of a pair of second cylinder halves located on the bottom side of the coupling section. The first cylinder halves alternate in position lengthwise along the core support with the second cylinder halves.

Still further, each of the coupling sections can include a first bracket extending angularly upwardly, with the first bracket having a lip so as to form a slot. A second bracket has a configuration substantially identical to the first bracket, with a lip forming a slot with a main body of the second bracket. A third bracket is angled outwardly and upwardly. A fourth bracket is substantially identical to each of the first, second and third brackets, with a lip forming a slot with the main body of the fourth bracket. The first bracket is located on the same side of the core support as the fourth bracket. The first bracket faces upwardly, and the fourth bracket faces downwardly. The second bracket and the third bracket are each located on the same side of the coupling section. The third bracket extends upwardly, and the second bracket extends downwardly. A series of flanges are positioned directly across from each of the first, second, third and fourth brackets. Each of the flanges includes a catch edge. A series of hollow chambers is positioned intermediate the flanges and the first, second, third and fourth brackets. The chambers include a first chamber and a second chamber, with each of the chambers opening upwardly. The hollow chambers also include a third chamber and a fourth chamber. The third and fourth chambers are positioned in alternating positions relative to the first and second chambers.

When three of the core supports are coupled and interlocked together, the core supports form the apertures into which the core tubes are laid during assembly. In this manner, the tube assembly is formed, with the three core supports characterized as consisting of first, second and third core supports. The first core support is positioned so that a wide end bracket of the core support faces upwardly, and an opposing narrow end bracket of the core support faces downwardly. The second core support is positioned below the first core support, and is turned essentially "upside down" relative to the first core support. With the second core support being in a position upside down relative to the first core support, a wide end bracket of the second core support faces downwardly, and is on an opposing side of the wide end bracket of the first core support. A narrow end bracket of the second core support faces upwardly on an opposing side of the narrow end bracket of the first core support. One of the flanges and a corresponding catch edge of the flange of the first core support is captured within a slot formed within the narrow end bracket and lip of the second core support. At a forward portion of the first core support, the narrow end bracket, corresponding lip and corresponding slot are positioned so as to receive the catch edge of the flange of the second core support.

With respect to further concepts associated with assembly of the first, second and third core supports, the wide end bracket of the second core support faces downwardly. The lip thereof and corresponding slot are utilized to capture the catch edge of the flange of the second core support. The orientation of the third core support is the same as the orientation of the first core support. In this manner, the first and third core supports are vertically "reversed" from the orientation of the second core support. The wide end bracket of the third core support includes a slot which is utilized to capture a lower flange and catch edge of the second core support.

Still further, and with respect to the coupling sections of the first, second and third core supports assembled together, the first bracket of the second core support includes a lip and corresponding slot utilized to capture a flange and catch edge of the first core support. The third bracket of the first core support includes a lip and corresponding slot which extend downwardly and are utilized to capture a flange and catch edge of the second core support. A second bracket of the third core support extends upwardly, and includes a lip and slot which capture a flange and catch edge of the second core support. Still further, a fourth bracket of the second core support extends downwardly, and includes a slot which captures a flange and catch edge of the third core support.

BRIEF DESCRIPTION OF THE DRAWINGS

An illustrative embodiment of the invention will now be described with respect to the drawings, in which.

DESCRIPTION OF THE PREFERRED EMBODIMENT

Figure 1:
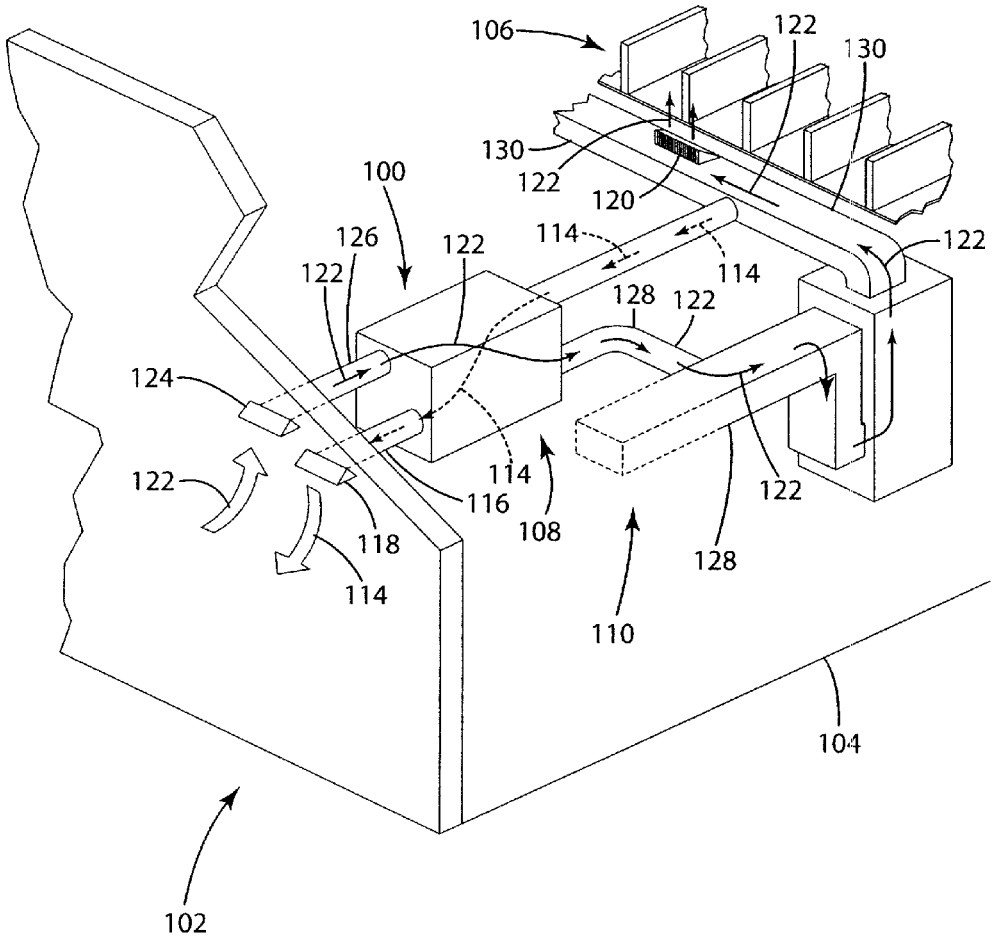
FIG. 1 is a partially perspective and partially schematic diagram of a thermal energy exchanger in accordance with the invention, as the exchanger may be utilized within an example building environment.

The principles of the invention are disclosed, by way of example, within a thermal energy exchanger assembly 100 as illustrated in FIGS. 1-29. Assembly 100 in accordance with the invention provides significant advantages over the prior art. For example, with the tube designs and core plate designs in accordance with certain aspects of the invention, assembly speed can be facilitated. Further, with the use of plastic elements for the thermal energy exchanger assembly 100, the longevity of the thermal energy exchanger is relatively increased, due to the elimination of components which are subjected to rust or the like. Also, the energy exchanger assembly 100 is adapted to operate without requiring any internal moving parts. For exchanger assemblies requiring moving parts (such as internal fans or the like), it is common for such parts to be metal. Such additional metal parts are clearly subject to rust. In accordance with one aspect of thermal energy exchanger assemblies in accordance with the invention, the internal components of the energy exchanger assembly are essentially "passive." If fans or other components are desired to be used to increase the airflow, such fan units or the like may be positioned exterior to the exchanger assembly. With respect to the plastic elements of the energy exchanger assembly 100, core tubes 180 (FIG. 21) as described subsequently herein may be manufactured of polypropylene. Still further, thermal energy exchanger assemblies in accordance with the invention provide for relatively greater efficiency, in that exchange rates are improved between the airstreams flowing within the exchanger assembly. For example, and in accordance with certain aspects of the invention, the core tubes 180 may have relatively thin walls, in view of their manufacture from plastic materials. These relatively thinner walls improve thermal energy transfer. In addition, and as made apparent from subsequent description herein, the thermal energy exchanger assembly 100 in accordance with other aspects of the invention may have a core assembly which provides for substantially more surface area for thermal energy transfer between airstreams.

Still further, some known tubular and end plate designs have a tendency to accumulate dirt and dust particles. The dirt and dust can eventually plug up a thermal energy exchanger core, and reduce exchange efficiency and air flow. Further, thermal energy exchanger assemblies having these properties are often difficult to clean, because such cleaning typically requires the disassembly of the unit periodically, so as to maintain efficiency. The thermal energy exchanger assemblies in accordance with certain aspects of the invention utilize designs which may reduce the frequency of requisite cleaning, and also facilitate the cleaning process itself. In this regard, the thermal energy exchanger assembly 100 in accordance with these certain aspects of the invention may include the use of air filters for reducing the amount of dirt and dust which would otherwise typically collect around and in components of the exchanger assembly.

In accordance with all of the foregoing, thermal energy exchanger assemblies in accordance with certain aspects of the invention are advantageous in that they have relatively few moving parts, and are relatively less susceptible to wear, including rust processes. However, if desired, the structure and function of thermal energy exchangers in accordance with the invention do not preclude the use of some moving parts, such as a fan or the like for facilitating air movement.

Still further, and again in accordance with certain aspects of the invention, thermal energy exchanger assemblies in accordance with these aspects of the invention may employ relatively thin wall plastic tubes, utilizing "film heat transfer" technology. Such technology provides for passing thermal energy from one airstream to another, without mixing the air at a rate comparable to exchange components comprised of various metals, such as aluminum. Also, as a result of the internal diameter of the tubes in accordance with certain aspects of the invention, they will tend to reject "freeze up" in cold weather, which may otherwise require defrosting cycles. Still further, and in accordance with other aspects of the invention, core support assemblies utilized in thermal energy exchanger assemblies in accordance with these aspects of the invention advantageously utilize a design where the core support assemblies are made of pre-formed inserts, allowing for tubes to be relatively quickly assembled into the core plates and sealed with compression. Still further, core plate designs in accordance with certain aspects of the invention will function with current plastic tubes, as well as enthalpic tubes known to be utilized for energy recovery ventilators. In addition, if desired, core plate designs in accordance with these aspects of the invention will also function with metal tubes, such as copper or aluminum, without requiring design changes to overall exchanger units.

Turning specifically to the drawings, FIG. 1 is a partially schematic and partially diagrammatic diagram of the thermal energy exchanger assembly 100 in accordance with the invention, as it may be utilized within a building environment 102. The building environment 102 may be an industrial, commercial or residential structure. Also, as earlier described, thermal energy exchanger assemblies in accordance with the invention may be utilized in other environments, such as vehicles. The thermal energy exchanger assembly 100 may be located within a structure 104 associated with the building environment 102. The structure 104 may be constructed in a manner so that it is somewhat separate from the interior 106 of the industrial, commercial or residential environment being serviced by the thermal energy exchanger assembly 100. Again, it should be emphasized that FIG. 1 is essentially a schematic and diagrammatic illustration, and does not represent particular components which form the basic novel concepts of the invention.

The thermal energy exchanger assembly 100 itself is essentially enclosed within an external housing 108, which may be in the form of any conventional structure. The external housing 108 houses the principal components of the exchanger assembly 100 where the thermal energy exchange between airstreams representing stale air and fresh air actually occurs. The external housing 108 and associated components therein (described in subsequent paragraphs herein) are structurally and functionally connected to elements which can be characterized as forming a central ventilation system 110. The central ventilation system 110 provides means for guiding (and, to some extent, forcing) airstreams comprising fresh air and stale air through the external housing 108 of the thermal energy exchanger assembly 100. It should be emphasized that numerous configurations of ventilation systems may be utilized in substitution of the central ventilation system 110, without departing from the principal spirit and novel concepts of the invention.

Continuing to refer to FIG. 1, the central ventilation system 110 includes an incoming stale air plenum 112. The plenum 112 may be coupled to the building interior 106 and open to stale air duct work which provides a series of stale air pathways around the interior 106. This stale air duct work may be open to the interior 106 through a series of ventilator screens (not shown) so as to provide for common stale air pathways throughout the interior 106. Although often not necessary, and depending upon the type and size of the interior 106, ventilation fans (not shown) may be utilized within the interior 106 or stale air duct work for purposes of facilitating air flow through the duct work and the incoming stale air plenum 112. In any event, the central ventilation system 110 is structured so that a stale airstream 114 (which is shown as a series of "dotted line" arrows in FIG. 1) is expelled from the interior 106 through the incoming stale air plenum 112.

As further shown diagrammatically in FIG. 1, the stale airstream 114, consisting of stale air which is often of relatively high or low temperatures (depending upon geographical locations and the particular seasons of the year), will flow through the interior of the exterior housing 108 of the thermal energy exchanger 100. The stale airstream 114 will then be expelled into and flow through an outgoing stale air plenum 116. At a terminating end of the outgoing stale air plenum 116 may be an outgoing stale air vent 118. The vent 118 may be open to an outside environment, and utilized to expel the stale airstream 114 which has flowed through the thermal energy exchanger assembly 100. However, as will be made readily apparent from subsequent description herein, before the stale airstream 114 is expelled from the exterior housing 108 of the thermal energy exchanger assembly 100, an energy transfer will have occurred between the stale airstream 114 and a fresh airstream 122 described in subsequent paragraphs herein.

In addition to the stale airstream 114, the fresh airstream 122 is also provided for flow through the thermal energy exchanger assembly 100. The fresh airstream 122 is diagrammatically illustrated in FIG. 1 as a series of arrows in solid line format. Again referring to FIG. 1, the fresh airstream 122 can be formed from fresh air outside of the building environment 102. The fresh airstream 122 can be brought into the interior 106 through an incoming fresh air vent 124, with the fresh air vent 124 openly connected to an incoming fresh air plenum 126. For purposes of forming the fresh airstream 122, and bringing fresh outside air into the building environment 102 and interior 106, furnace fans (not shown) or other types of fan mechanisms may be employed. Such fan configurations are well known in the HVAC art. However, in accordance with certain aspects of the invention, it is believed that the use of core tubes and other components consisting of plastic materials, along with the wall designs of the plastic tubes, may be such that fans or other active components are unnecessary for providing requisite airflow of the airstreams 114, 122 through the thermal energy exchanger assembly 100. That is, the thermal energy exchanger assembly 100 may have a structure and design such that it is a completely "passive" thermal energy exchanger, without requiring any energy driven or other moving parts.

After the fresh airstream 122 is brought into the building environment 102 through the incoming fresh air vent 124, the fresh airstream 122 flows through the incoming fresh air plenum 126 and into the exterior housing 108 of the thermal energy exchanger assembly 100. The thermal energy exchange function and the specific flow of the fresh airstream 122 through the thermal energy exchanger assembly 100 will be described in greater detail in subsequent paragraphs and with respect to subsequent illustrations herein.

After the fresh airstream 122 has flowed through the thermal energy exchanger assembly 100 (and warmed or cooled during the energy exchange process), the airstream 122 will then flow outwardly from the thermal energy exchanger assembly 100 into an outgoing fresh air plenum 128. The outgoing fresh air plenum 128 may be connected, as illustrated in FIG. 1, to fresh air duct work 130. The duct work 130 may provide for common pathways and may be openly connected through ventilation screens (such as the ventilation screen 120 illustrated in FIG. 1) to the interior 106. With this central ventilation system 110, and through the use of the thermal energy exchanger assembly 100, fresh outside air is brought into the interior 106, while a substantially equal amount of stale air is exhausted through the ventilation system 110 to the outside. Further, as described in subsequent paragraphs herein, the incoming fresh airstream 122 may be filtered, before flowing through the core structure (described in subsequent paragraphs) of the thermal energy exchanger assembly 100. Such a filtering configuration is described in subsequent paragraphs herein and illustrated in the drawings. Within the housing 108 of the thermal energy exchanger assembly 100, the stale airstream 114 flows across what could be characterized as the "cross-flow" exchanger assembly 100, and may then transfer its heat (or, if operating in the summer or geographical area having a continuously warm climate, transfer coolness) to the fresh airstream 122. The fresh airstream 122 passes through the tubes 180 and is then distributed in a preferably even manner throughout the interior 106. This distribution can occur through the existing duct work 130 already employed for a conventional HVAC system. In accordance with all of the foregoing, stale and polluted air is expelled to the outside from the interior 106.

Figure 2:
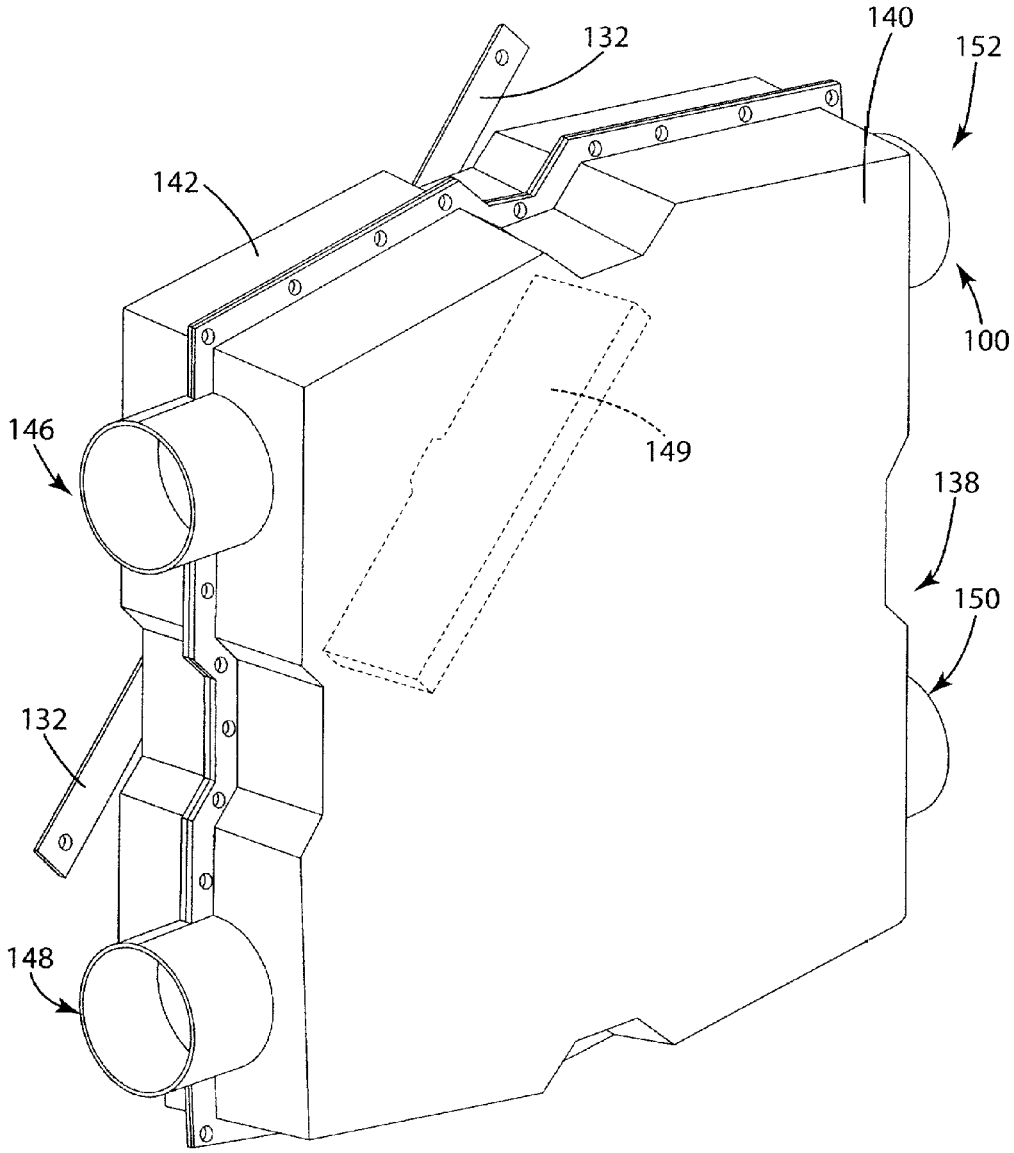
FIG. 2 is a perspective view of the thermal energy exchanger in accordance with the invention, showing the relative configuration of the housing.
Figure 3:
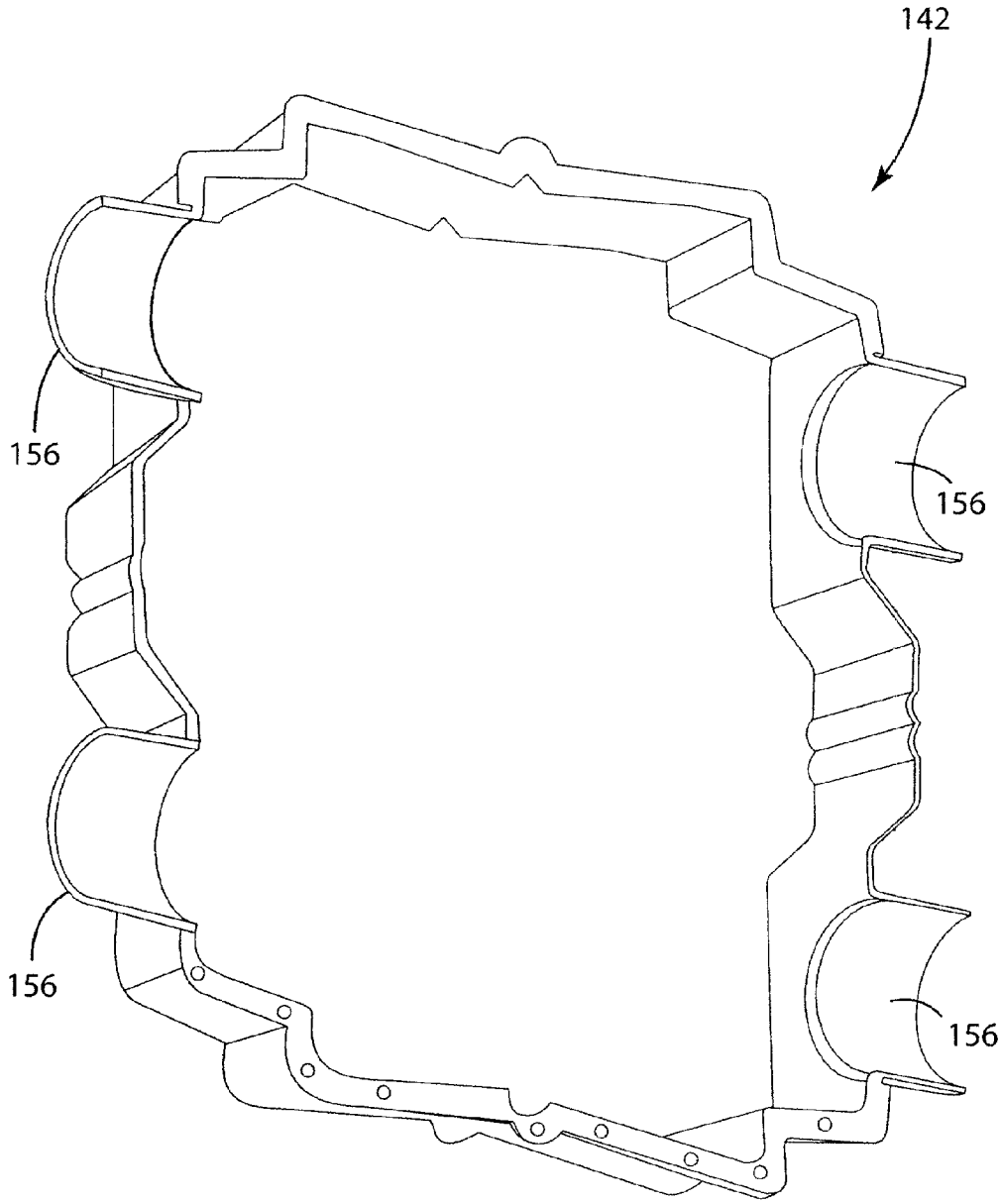
FIG. 3 is a perspective view of one half of the housing of the thermal energy exchanger shown in FIG. 2.
Figure 4:
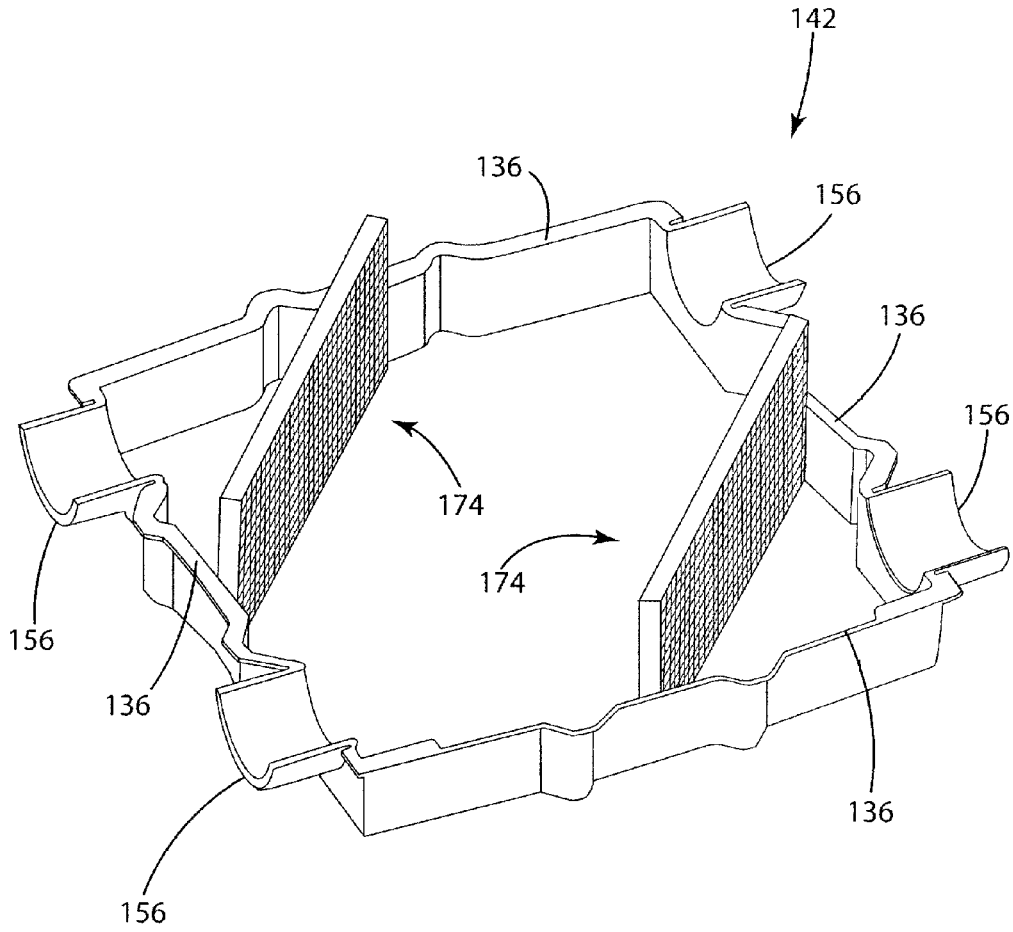
FIG. 4 is a perspective view of the housing half illustrated in FIG. 3, and further showing a pair of core support assemblies (without tubes) and their relative positioning within the housing half.

The general structure and configuration of the thermal energy exchanger assembly 100 will now be described, primarily with respect to FIGS. 2-20. First, FIG. 2 is a perspective view of the exterior of the thermal energy exchanger assembly 100. As illustrated in FIG. 2, the thermal energy exchanger assembly 100 includes an exchanger housing 138. With respect to the relationship between the exchanger housing 138 and components illustrated in FIG. 1, the exchanger housing 138 (and the internal components of the thermal energy exchanger assembly 100) are housed within the exterior housing 108. As further shown in FIG. 2, the exchanger housing 138 comprises a first housing half 140 and a corresponding second housing half 142. The references to "first" and "second" are for convenience only, and do not necessarily represent any particular spatial configuration requisite for the exchanger assembly 100. The housing halves 140, 142 may be manufactured by injection molding or similar plastic molding or forming processes. FIGS. 3 and 4 illustrate the structure of the second housing half 142 in a stand alone configuration. FIG. 4 also illustrates the second housing half 142 with a pair of opposing core support assemblies which will be described in subsequent paragraphs herein.

The first housing half 140 and the second housing half 142 may be connected together in any suitable manner. For example, the housing halves 140, 142 may include fasteners 144 (shown primarily in FIGS. 2, 8, 10, 11, 12, 13) which appropriately connect together the housing halves 140, 142. Such fasteners 144 may be in the form of bolts, clips or similar connecting elements. For example, in certain of the drawings of FIGS. 2-20, the fasteners 144 are shown as clips 143, while others of the drawings show the fasteners 144 as relatively small bolts 145.

Figure 5:
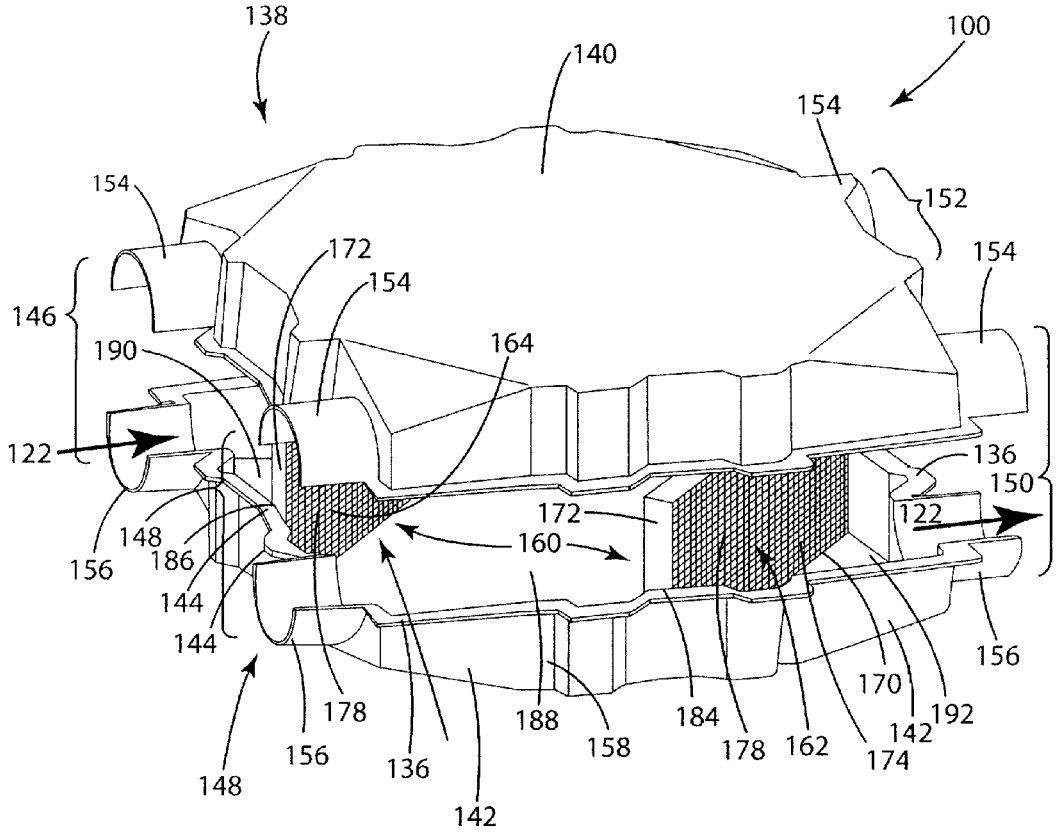
FIG. 5 is a perspective and partially exploded view of the thermal energy exchanger in accordance with the invention, showing one of the housing halves and the pair of core support assemblies as illustrated in FIG. 4, but further showing the other housing half in a partially exploded view and also showing upper and lower frame portions which are coupled to the core support assemblies (without tubes) so as to form the core plates.

As further shown, for example, in FIG. 5, the first and second housings 140, 142, respectively, form an incoming fresh air duct 146 having a cylindrical configuration. The incoming fresh air duct 146 may preferably be coupled to the incoming fresh air plenum 126 previously described with respect to FIG. 1. Accordingly, the duct 146 is utilized to bring fresh air into the exchanger assembly 100. As further shown in FIG. 5, the incoming fresh air duct 146 may be constructed of a pair of substantially equally formed duct arcs comprising a first duct arc 154 and a second duct arc 156.

In addition to the incoming fresh air duct 146, the thermal energy exchanger assembly 100 also includes, as shown on the same side of the housing 108, an incoming stale air duct 148. The incoming stale air duct 148, like the fresh air duct 146, consists of a first duct arc 154 and a second duct arc 156. The incoming stale air duct 148 is adapted to be coupled, in any suitable manner, to the incoming stale air plenum 112, previously described with respect to FIG. 1. In addition to the ducts 146 and 148, a pair of additional ducts 150 and 152 are located on the end of the housing 108 opposing the end on which the ducts 146 and 148 are located. Duct 150 can be characterized as an outgoing fresh air duct 150. The outgoing fresh air duct 150 is adapted to be coupled, in any suitable manner, to the outgoing fresh air plenum 128, previously described with respect to FIG. 1. As with the ducts 146, 148, the duct 150 is formed with a first duct arc 154 and a second duct arc 156.

Figure 11:
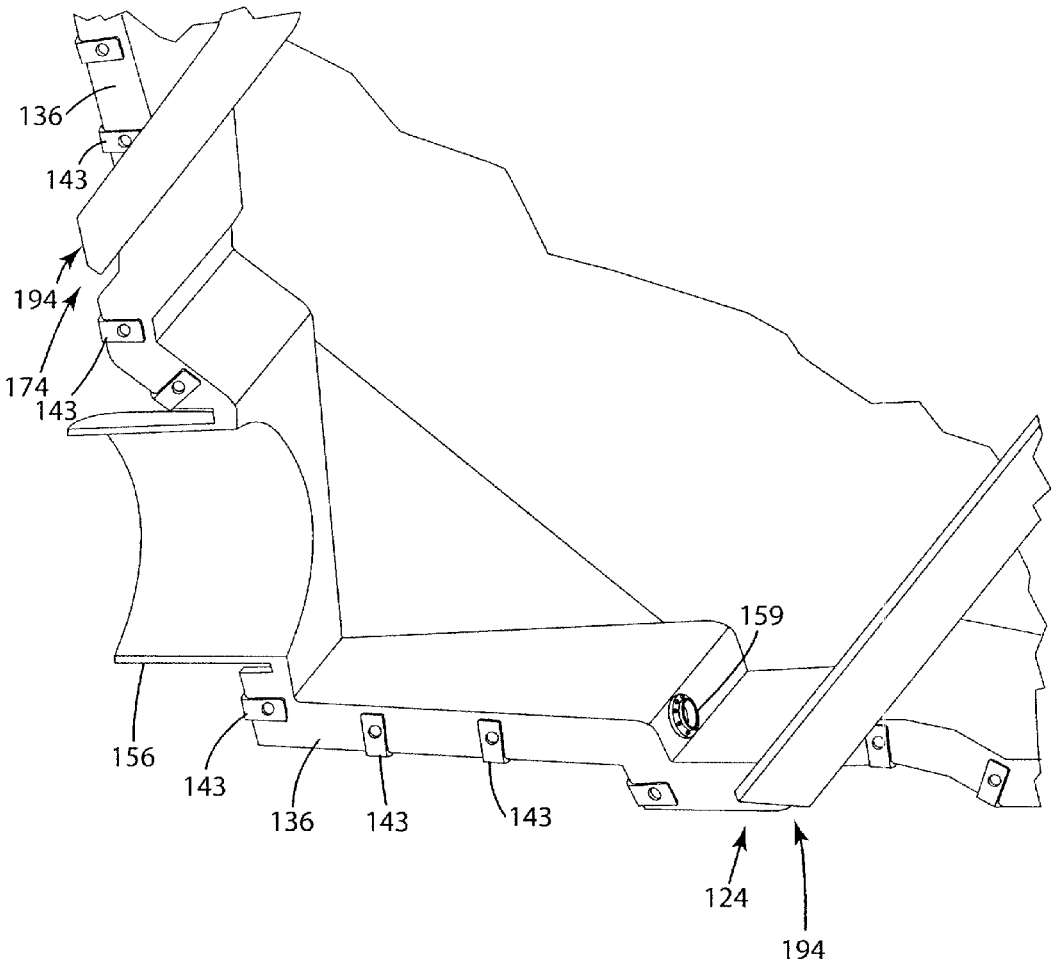
FIG. 11 is a perspective view of a portion of the thermal energy exchanger in accordance with the invention, showing the relative location of a drain aperture.
Figure 12:
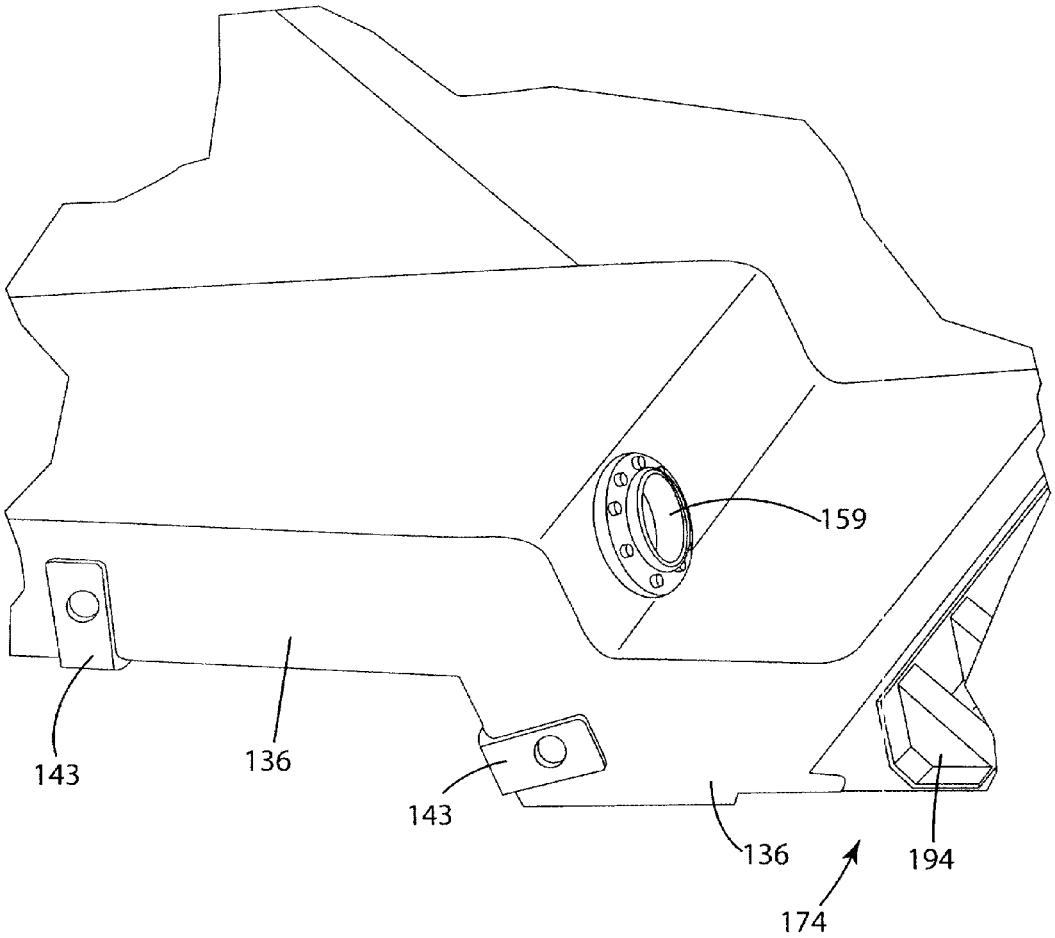
FIG. 12 is a perspective view similar to FIG. 11, but showing a drain aperture in a close-up configuration.
Figure 13:
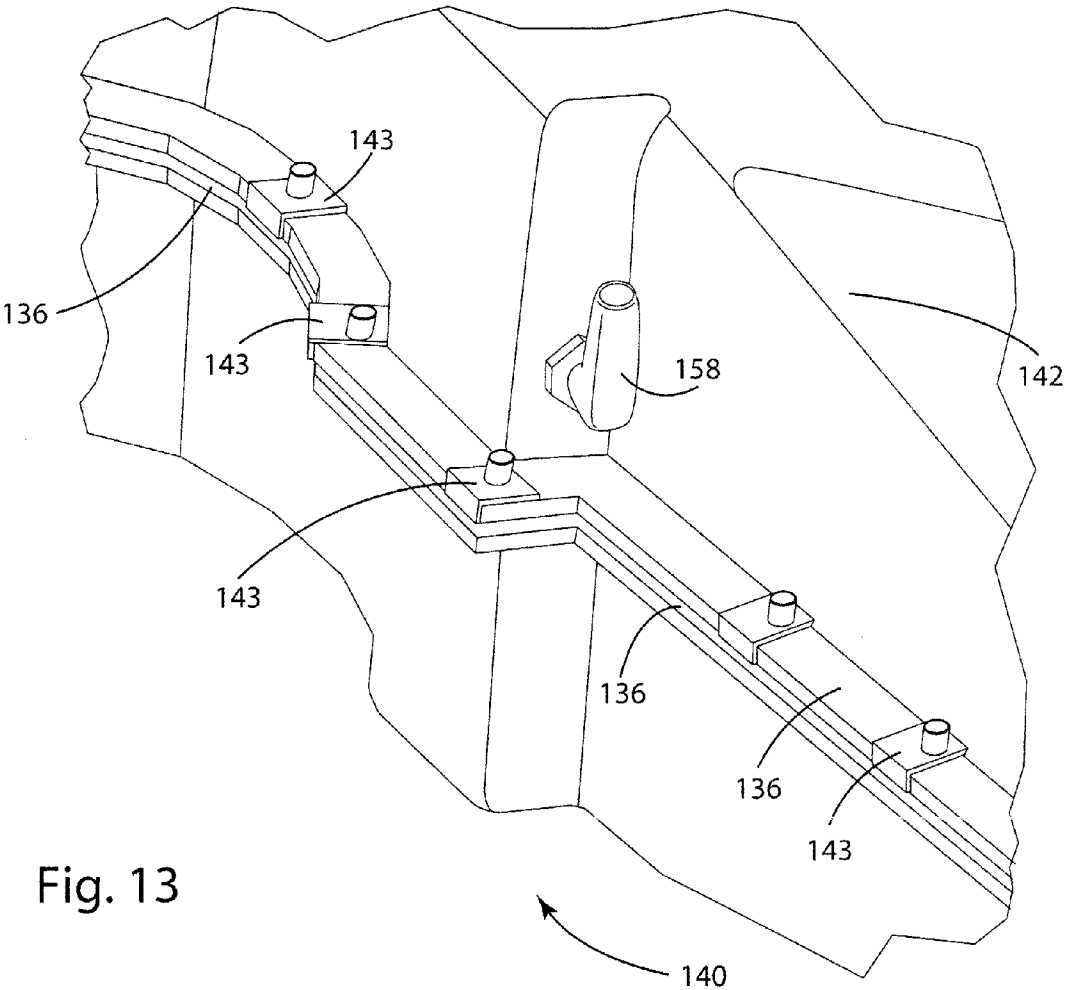
FIG. 13 is a perspective view of a portion of the thermal energy exchanger in accordance with the invention, showing the exterior location of one of the drain plugs of the exchanger.
Figure 14:
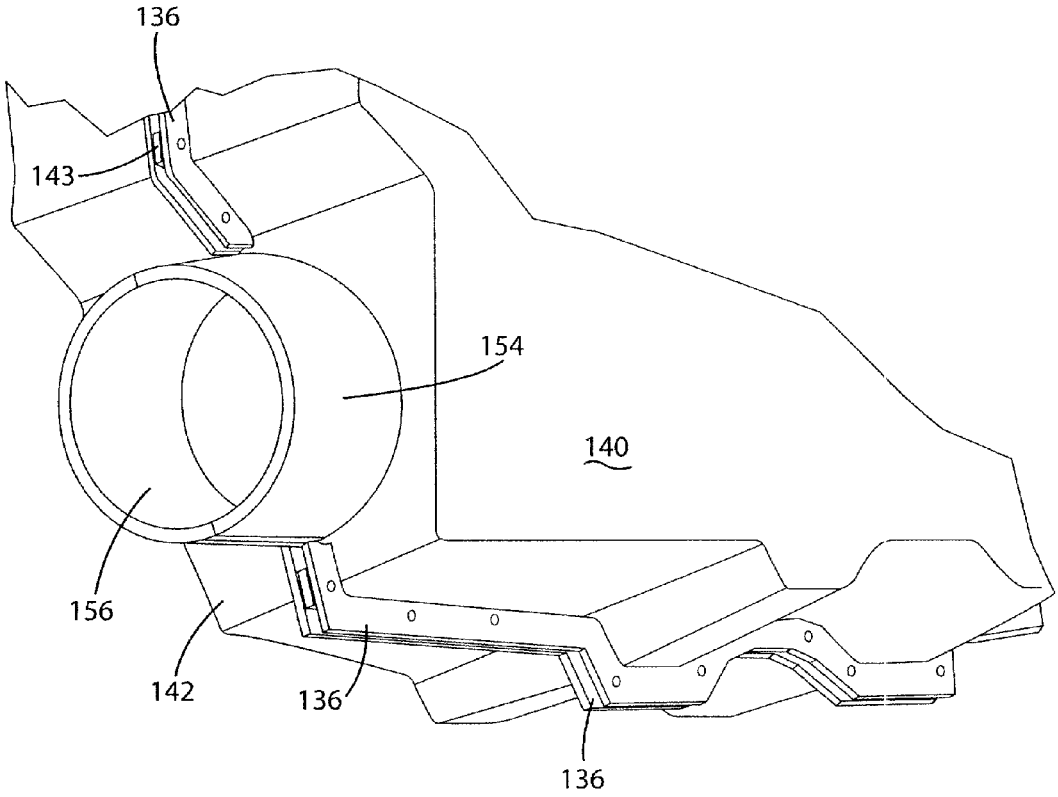
FIG. 14 is a perspective view of a portion of the thermal energy exchanger in accordance with the invention, showing a relatively close-up view of the connecting flanges on both of the housing halves for purposes of connecting the same together.
Figure 15:
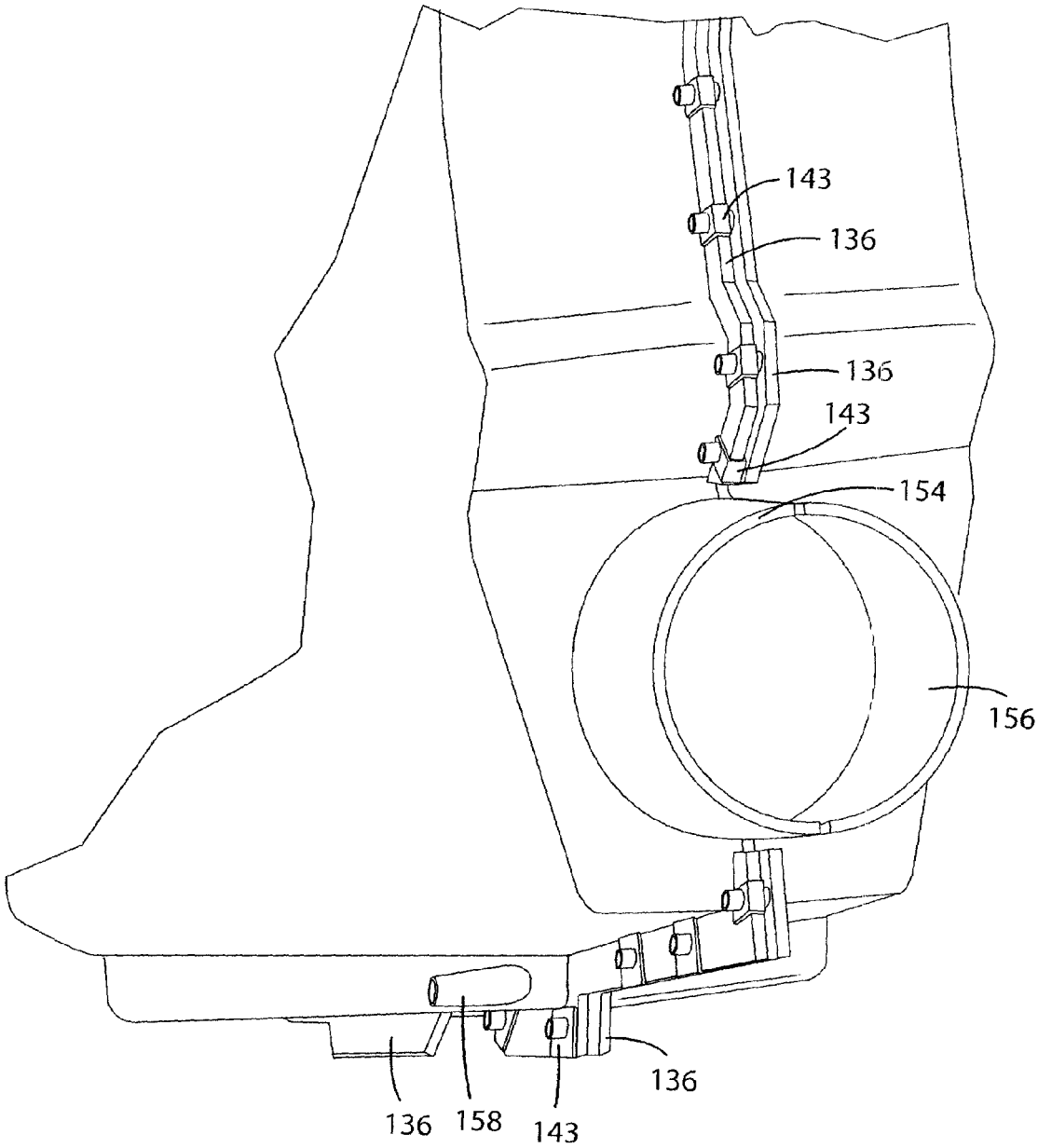
FIG. 15 is a perspective view of a portion of the thermal energy exchanger in accordance with the invention, showing another view of the connecting flanges and their relative position with respect to one of the drain plugs.

The duct 152, which is only partially shown in FIG. 5, can be characterized as an outgoing stale air duct 152. The outgoing stale air duct 152 is adapted to be coupled, in any suitable manner, to the outgoing stale air plenum 116. In FIG. 5, only the first duct arc 154 of the outgoing stale air duct 152 is illustrated. Still further, and again with reference to FIG. 5, second housing half 142 of the housing 138 can be fitted with a drain 158. The drain 158 will be located in an area where it may be enabled to drain water which has formed as condensed moisture as a result of heat being removed from the stale airstream 114 as the same passes through the exchanger assembly 100. Preferably, and as shown in various of the drawings, two drains 158 are provided with the exchanger assembly 100. More specifically, the drains 158 are illustrated in FIGS. 5, 6, 13, 15. The drains 158 are open to the interior of the exchanger housing 138 between core plates 160 through a pair of drain apertures 159. The drain apertures 159 are illustrated in FIGS. 11 and 12.

As further shown in FIGS. 4-10 and 16-20, the thermal energy exchanger assembly 100 also includes a pair of core plates 160. The core plates 160 are identified, for example, in FIGS. 4 and 5 as comprising a first core plate 162 and an opposing second core plate 164. The core plates 160 are also illustrated (or partially illustrated) in FIGS. 6-10, 19 and 20. The components of the core plates 160 and the general structure and functions thereof form the basis for a number of principal concepts of the invention.

However, before describing the core plates 160 and associated components in detail, other elements of the thermal energy exchanger assembly 100 will be described. More specifically, the immediately following paragraphs describe components associated with an air filter assembly, connector components for the exchanger housing 138 (FIG. 6) and elements for mounting the exchanger assembly 100 to other structures.

Reference will now be made to elements of the energy exchanger assembly 100 as shown in FIGS. 2, 6-10, 13 and 16. More specifically, the exchanger housing 138 can be mounted to components separate from the exchanger assembly 100 through the use of one or more housing connector brackets 132. These brackets are primarily shown for example, in FIGS. 2, 6 and 7. The housing connector brackets 132 can have a substantially rectangular configuration, with an elongated length. The brackets 132 can be connected to the exchanger housing 138 through the use of bolts 133 (FIGS. 6, 7) extending through appropriate apertures 134 and secured to the exchanger housing 138 in any suitable manner. Correspondingly, the housing connector brackets 132 may also include additional apertures 135 through which screws or other connecting means (not shown) may be secured to the housing connector brackets 132 and to other structural elements, such as the inner sides of the external housing 108 previously described and illustrated in FIG. 1. It should be emphasized that the use of the housing connecting brackets 132 represent only an example means for appropriately securing and positioning the thermal energy exchanger assembly 100 to various structures.

As earlier described, the exchanger housing 138 actually comprises a pair of housing halves. These housing halves are defined and illustrated as first housing half 140 and second housing half 142. As also previously described, fasteners 144 can be utilized to securely couple together the housing halves 140, 142. Still further, it was previously described that the fasteners 144 could be in the form of clips 143 or bolts 145. For example, in the exploded views of FIGS. 6 and 7, the drawings illustrate the use of bolts 145 extending through apertures 141 of the first and second housing halves 140, 142, respectively. The use of clips 143 is shown in several other views of the drawings, including FIGS. 8, 10 and 11.

Figure 6:
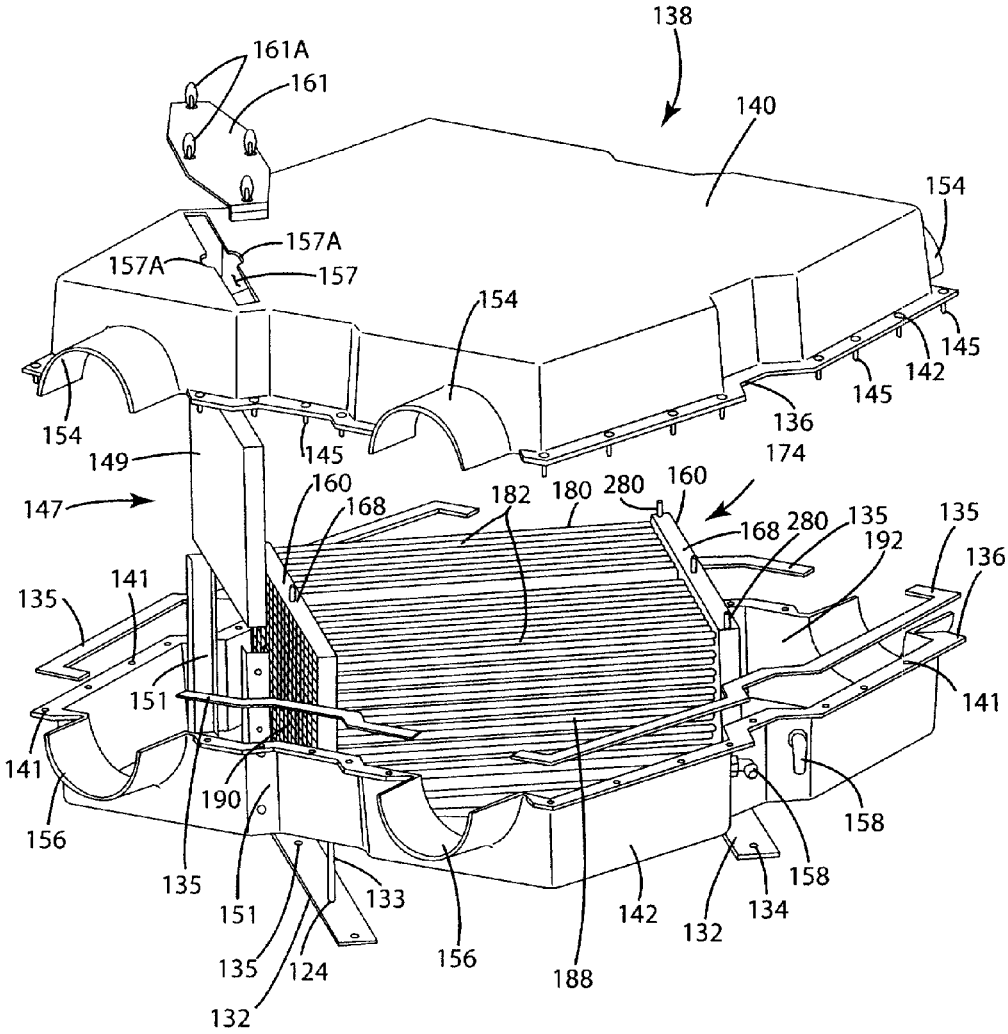
FIG. 6 is a perspective and exploded view of the thermal energy exchanger in accordance with the invention, showing the relative positioning of an air filter which may be used in an optional manner with the thermal energy exchanger in accordance with the invention, and further showing means for securing the air filter within the thermal energy exchanger.
Figure 7:
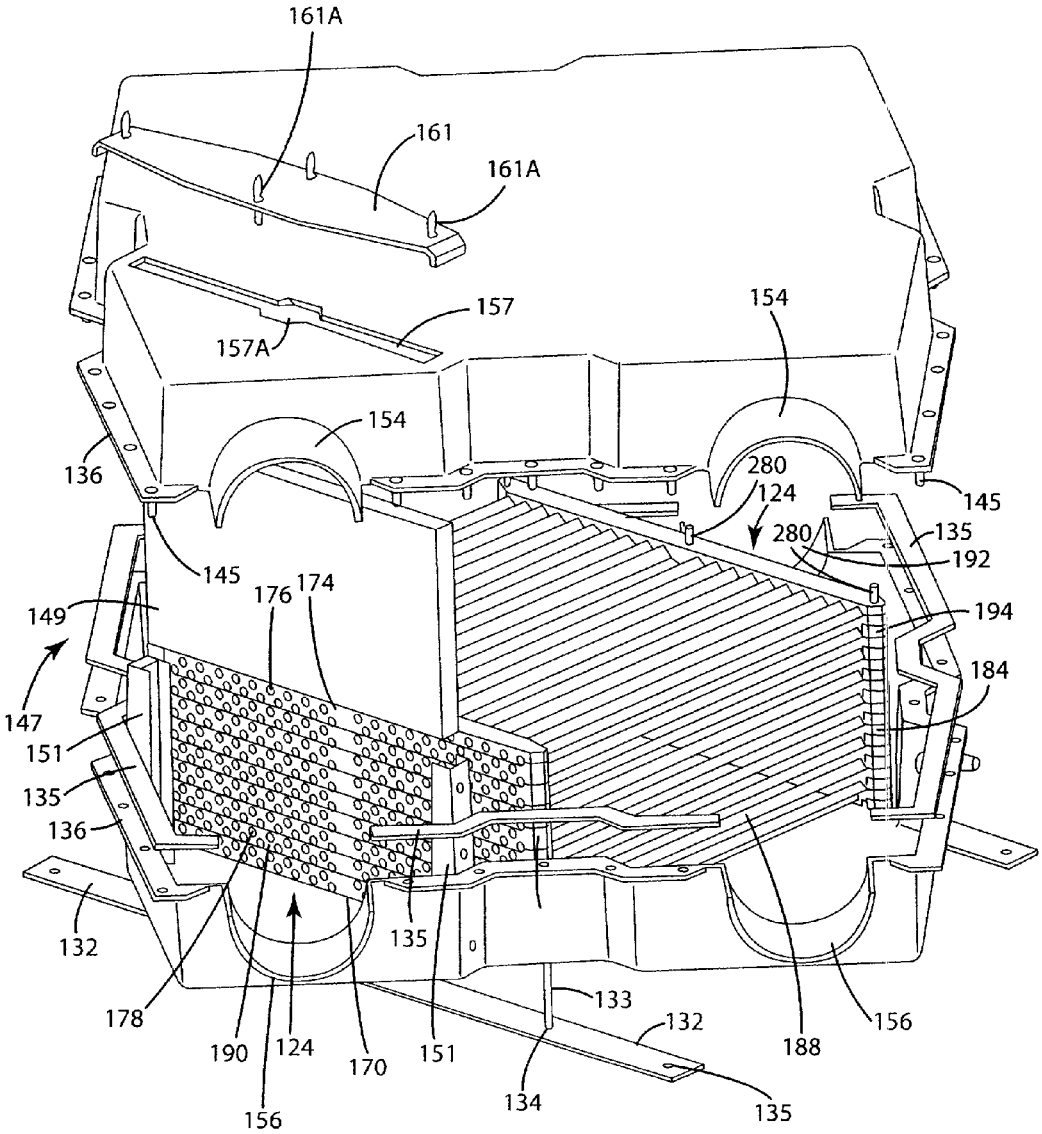
FIG. 7 is a perspective and partially exploded view similar to FIG. 6, but showing the thermal energy exchanger rotated approximately 45° relative to the perspective view of FIG. 6.
Figure 8:
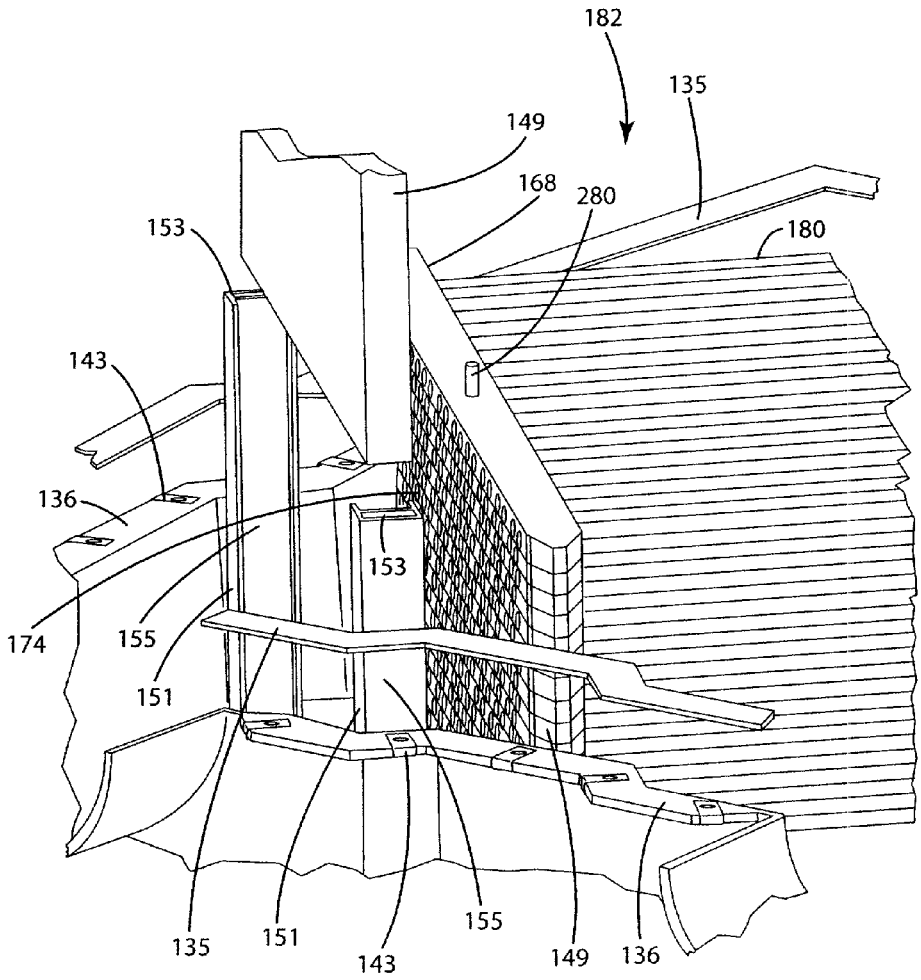
FIG. 8 is a perspective and partially exploded view in the form of a close-up view showing the positioning of the air filter relative to the core plate structure.
Figure 9:
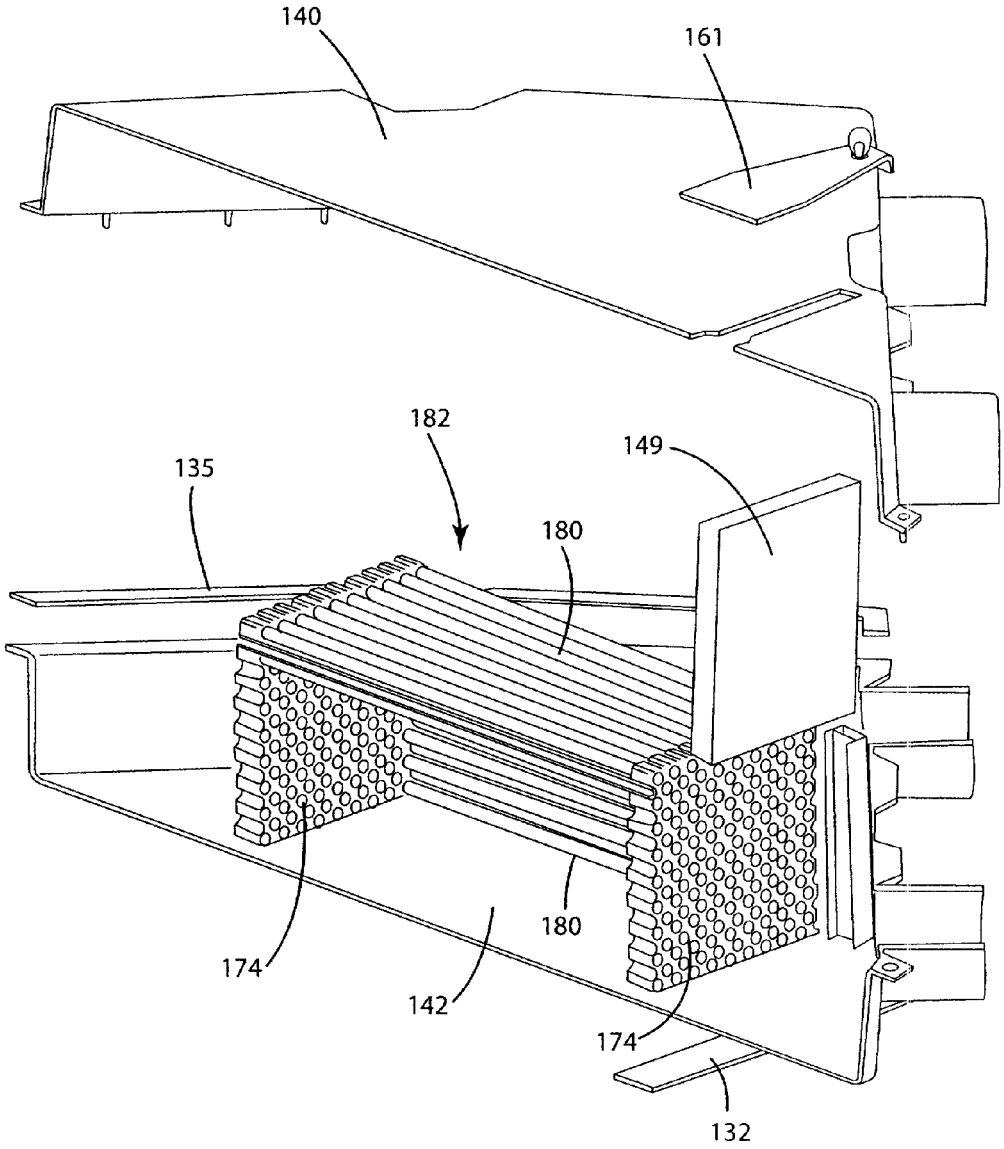
FIG. 9 is a perspective and exploded view of a portion of the thermal energy exchanger in accordance with the invention, showing the relative positioning of an air filter and also showing the core plate structure with a partial set of core tubes connected thereto.

As also shown in a number of the drawings, including FIGS. 6 and 7, the apertures 141 can be positioned within connecting flanges 136 which extend around the periphery of both the first housing half 140 and the second housing half 142. In addition, for purposes of providing a relatively tight seal for the connection between the housing halves 140, 142, a series of gaskets 135 may be utilized. Such gaskets are illustrated in, for example, FIGS. 6, 7, 8 and 10. The gaskets 135 can be utilized in a conventional manner and positioned intermediate the connecting flanges 136 of the first housing half 140 and second housing half 142 when the halves are coupled together.

In addition to the elements of the energy exchanger assembly 100 primarily utilized for coupling together the halves of the exchanger housing 138, the energy exchanger assembly 100 also includes other additional components separate from components associated specifically with the core plates 160. For example, the thermal energy exchanger assembly 100 may also include an air filter assembly 147. The air filter assembly 147 (or individual components thereof) is primarily shown in FIGS. 6-10 and 16. With reference thereto, the air filter assembly 147 includes an air filter 149 which is positionable in front of what is shown as the first core plate 162. The air filter 149, when positioned in front of the first core plate 162, is utilized to filter dust and allergens from the incoming fresh airstream 122. The air filter 149 is supported at its opposing ends by a pair of filter support brackets 151. As shown particularly in FIG. 16, each of the filter support brackets 151 includes a tubular aperture 153 extending lengthwise from the top to the bottom of each filter support bracket 151. The tubular apertures 153 can be utilized to support elongated bolts or similar connecting means (not shown) for purposes of securing the filter support brackets 151 to the exchanger housing 138. As further shown in FIG. 16, each of the filter support brackets 151 also includes a filter channel 155. The filter channels 155 of each support bracket 151 face towards each other and are utilized to capture the ends of the air filter 149 as the air filter 149 may be slid into appropriate position in front of the first core plate 162.

The thermal energy exchanger assembly 100 also includes means for removing and replacing air filters 149, without requiring the disassembly of the housing halves 140, 142 of the thermal energy exchanger assembly 100. More specifically, and again as shown in several of the drawings, including FIGS. 6 and 7, the first housing half 140 is illustrated as having a filter slot 157 with an elongated length and positioned immediately above the filter support brackets 151. The filter slot 157 includes a pair of finger notches 157A. When it is desired to utilize the air filter 149 with the exchanger assembly 100, the air filter 149 can be slid into the filter support brackets 151 (and, specifically, the filter channels 155) through the filter slot 157. When it is desired to remove the filter, the user can grasp the air filter 149 (with the finger notches 157A facilitating the removal) and pull the air filter 149 outwardly through the slot 157. For purposes of maintaining the interior of the exchanger housing 138 as clean as possible, the filter slot 157 can be covered by a removable filter cover 161. The filter cover 161 can be secured to the surface of the first housing half 140 through manually operable locking latches 161A or similar known securing means.

Although the foregoing has described an air filter assembly 147 which may be utilized in accordance with the invention, a number of the novel concepts of the invention do not require an air filter assembly. When not required, the exchanger housing 138 can be constructed without the necessity of a filter slot 157 or the like. Such a configuration is illustrated in FIG. 5.

The configuration of the core plates 160 will now be described in greater detail. More specifically, and as earlier stated, the core plates 160 are illustrated in a number of drawings, including FIGS. 4-10 and 16-20. Still further, the core plates 160 are characterized as comprising a first core plate 162 and an opposing second core plate 164. The core plates 162 and 164, are positioned within the exchanger housing 138 so as to face each other, with each of the core plates 160 having a configuration and disposition substantially parallel to the other one of the core plates 160. As described in subsequent paragraphs herein, the core plates 160 are utilized to provide support for the core tubes utilized in accordance with the invention, and also utilized to form appropriate air barriers within the exchanger housing 138. These barriers define particular spatial areas for movement of the stale airstream 114 and the fresh airstream 122.

Figure 10:
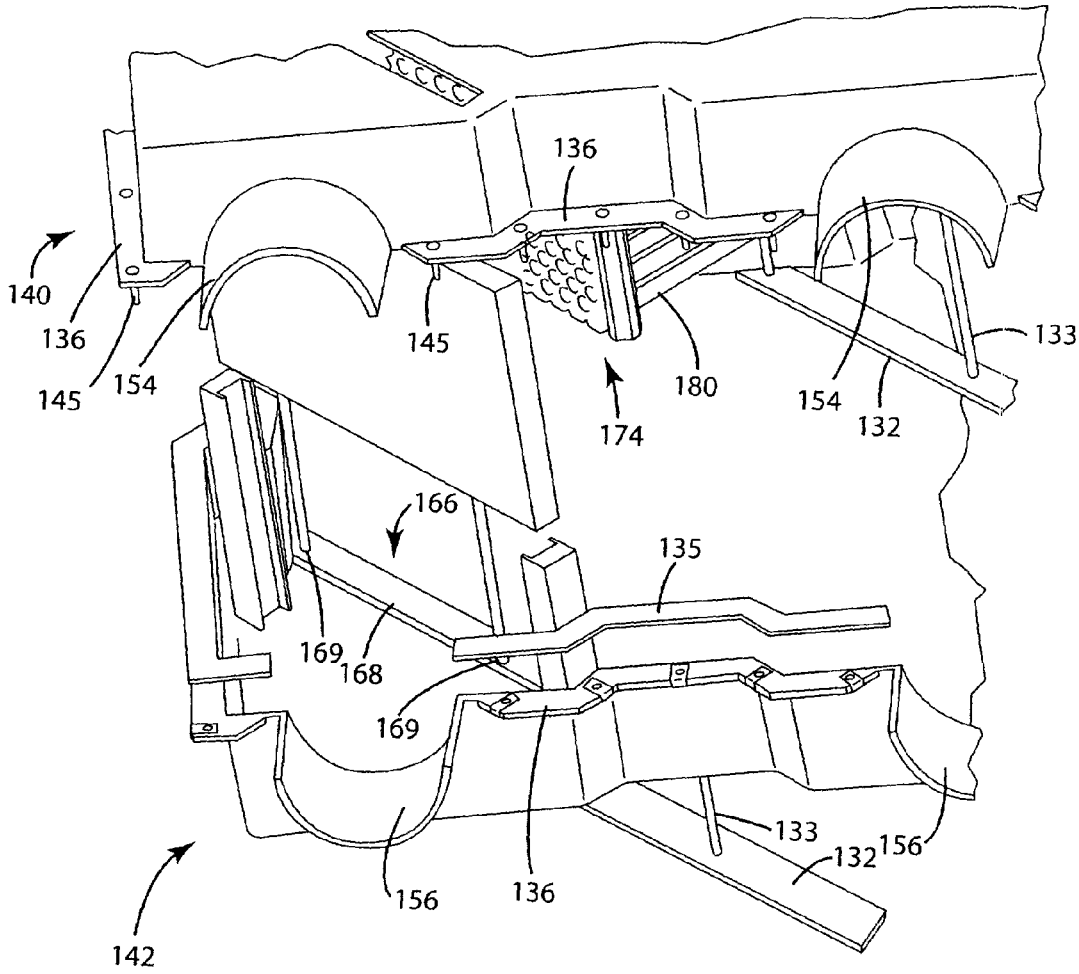
FIG. 10 is a perspective and exploded view of a portion of the thermal energy exchanger in accordance with the invention, again showing relative positioning of the air filter and other components of the thermal energy exchanger.

Each of the core plates 160 may include one or more components of what could be characterized as a frame assembly 166. The frame assembly 166 is shown in various parts in FIGS. 10 and 16. If desired, the frame assembly 166 for each of the core plates 160 can be utilized to provide a framing and positioning structure, and also to facilitate the sealing of various air spaces associated with the thermal energy exchanger assembly 100. The frame assembly 166 associated with one of the core plates 160 can be substantially identical to the frame assembly 166 of the other of the core plates 160. With reference to FIG. 10, the frame assembly 166 can include what is characterized herein as a lower frame channel 168. The lower frame channel 168 can be utilized to capture one end or side of other components forming the core plates 160. The lower frame channel 168 can include a series of apertures 169 (FIG. 10) through which threaded rods or similar means can be utilized for purposes of maintaining the assembly of the core plates 160. If desired, each of the core plates 160 can also include what is characterized herein as an upper frame channel 170, primarily shown in FIG. 16. The upper frame channel 170 can be substantially identical to the lower frame channel 168, and can be provided to essentially capture one side of other components of the core plate 160. As with the lower frame channel 168, the upper frame channel 170 can also include a series of apertures 169 through which threaded rods can be utilized for purposes of assembly of the core plates 160.

Figure 16:
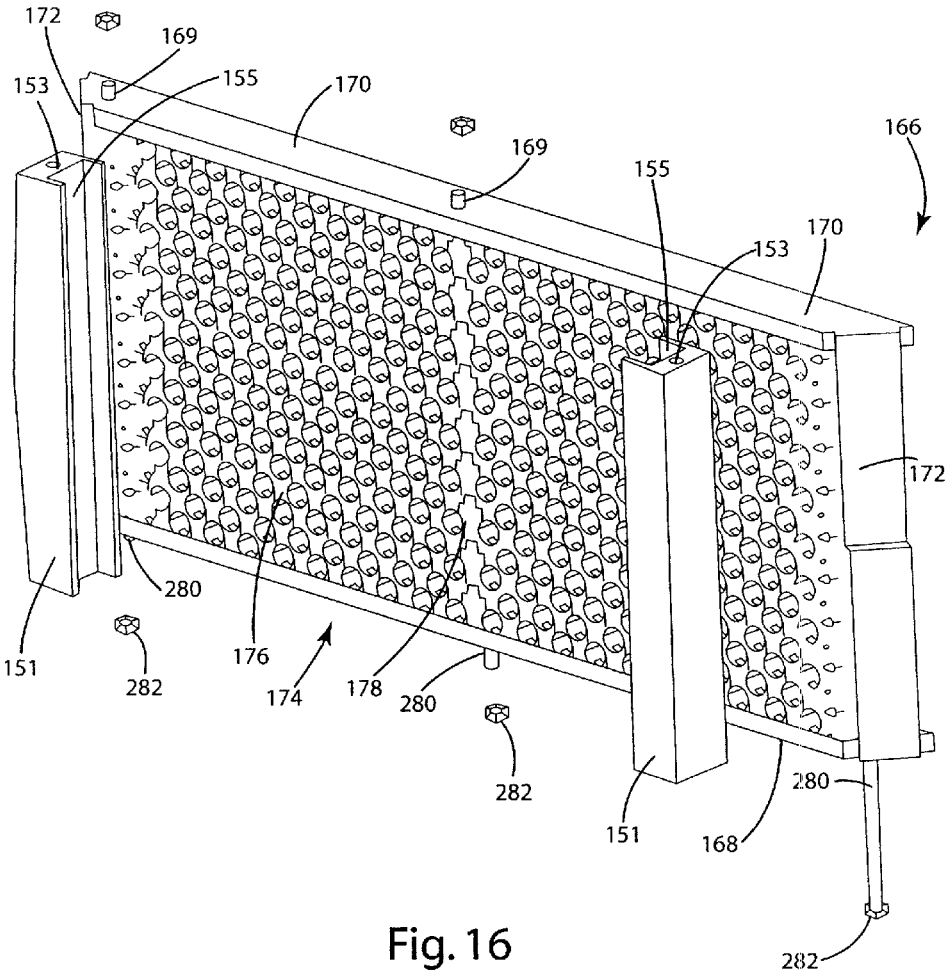
FIG. 16 is a perspective view showing one of the core plates and the support brackets for the air filter.
Figure 17:
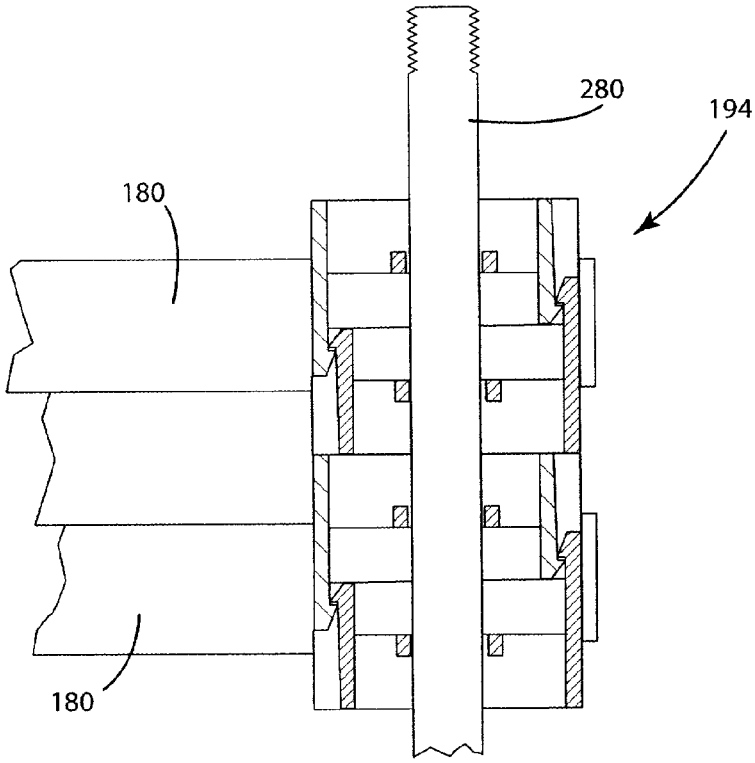
FIG. 17 is a sectional view of a portion of a core plate and core tubes coupled thereto, with the section taken through one of the threaded support rods.
Figure 18:
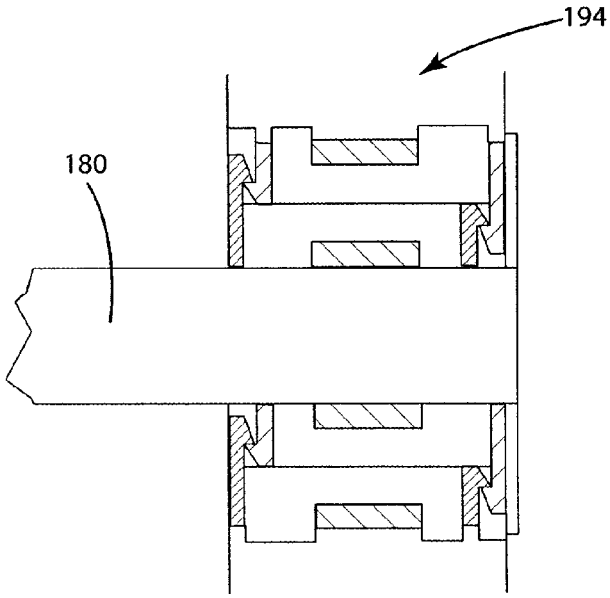
FIG. 18 is a sectional view similar to FIG. 17, but with the section taken across the core tubes.
Figure 19:
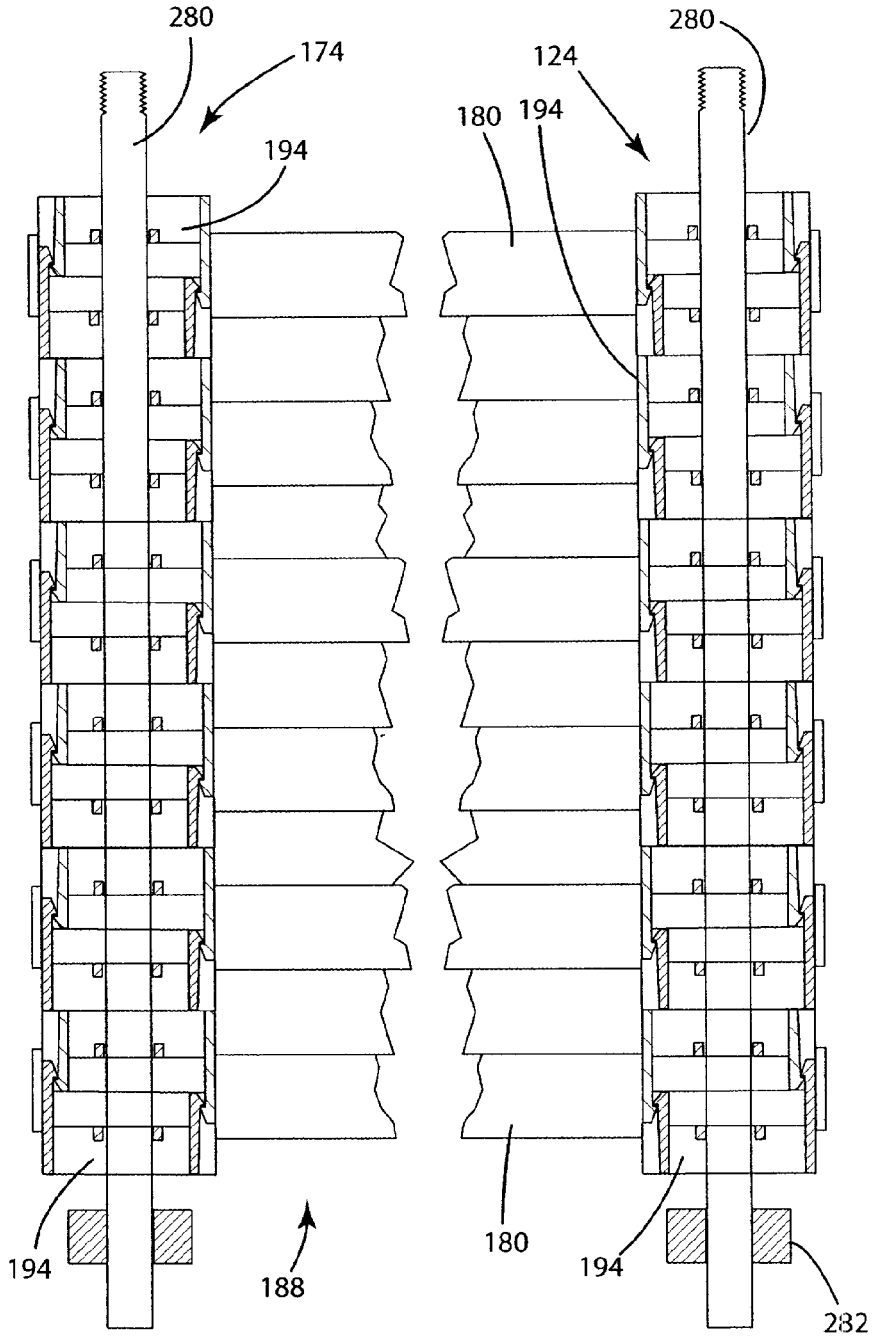
FIG. 19 is a sectional view partially showing the opposing core plates and the core tubes extending therebetween, and further shows threaded rods passing through the core supports, so as to assist in compression of the interlocking core supports and the compression fit of core tubes with the core supports.
Figure 20:
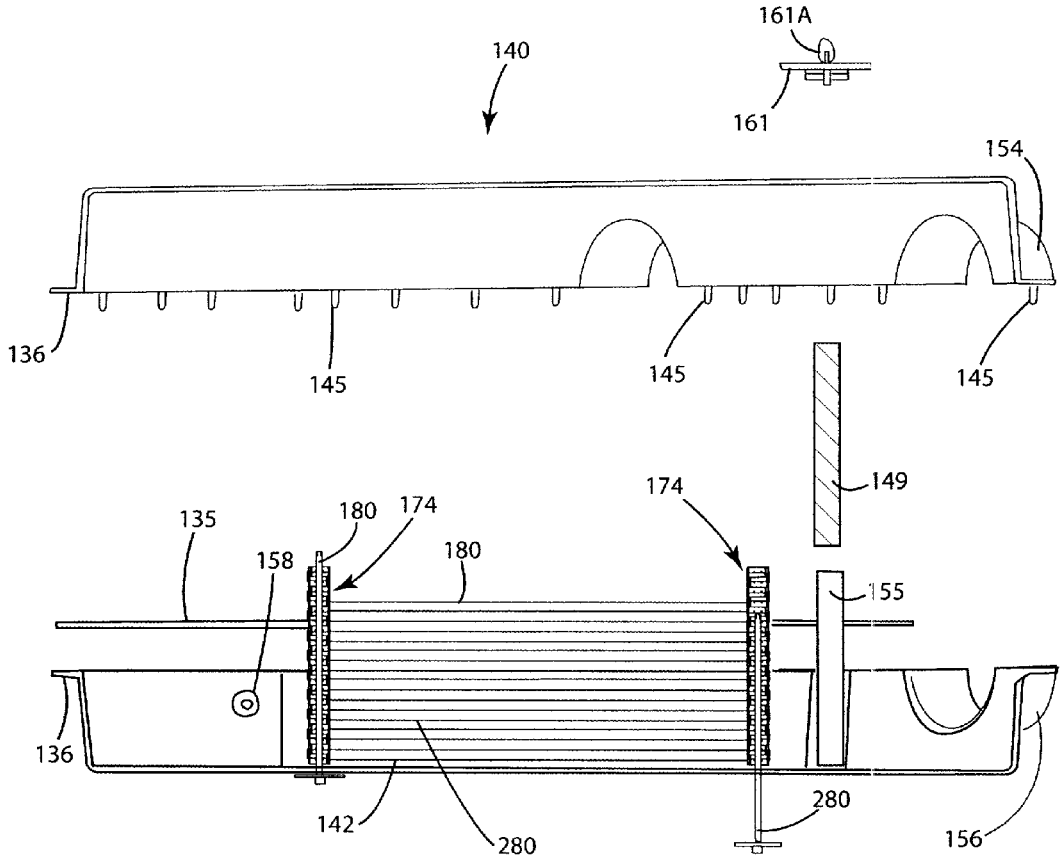
FIG. 20 is a perspective, partially exploded and sectional view showing the relative positioning of various components of one of the core plates and the housing halves.

Still further, if desired, the frame assembly 166 can also include a pair of opposing side fillers 172. Such example side fillers 172 are illustrated in FIG. 16. The side fillers 172 can be utilized to provide additional support for assembly of other components of the core plates 160. The side fillers 172 can also be formed of a cushion or similar type of material so as to provide a relatively tight seal between the sides of the core plates 160 and the side surfaces of the exchanger housing 138. Providing relatively air tight sealing between the air spaces through which the fresh airstream 122 and the stale airstream 114 flow improves efficiency of the energy exchanger assembly 100. Again, however, it should be emphasized that utilizing a frame assembly 166 and the particular frame components consist of options for the thermal energy exchanger assembly 100, and are not required to provide an exchanger assembly incorporating the principal concepts of the invention.

In addition to the optional frame assembly 166, each of the core plates 160 comprises what can be characterized as a core support assembly 174. The core support assembly 174 for the first core plate 162 is identical to the core support assembly for the opposing second core plate 164. FIG. 4 illustrates the two core support assemblies 174, in the absence of the optional frame assemblies 166. The core support assemblies 174 are shown, in whole and in part, in FIGS. 4-10 and 16-20.

When assembled, each of the core support assemblies 174 has what can be characterized as a honeycomb configuration 176. The honeycomb configuration 176 further forms a set of apertures or cylinders 178 having what can be characterized as an annular configuration.

The apertures or cylinders 178 within the honeycomb configuration 176 are utilized to support core tubes 180. The core tubes 180 are primarily shown in FIGS. 6-9 and 17-21. The core tubes 180 form what can be characterized as a tube assembly 182. The structure and function of the core tubes 180 will be described in subsequent paragraphs herein, as well as the assembly and structure of each of the core support assemblies 174.

Prior to the description of the core support assemblies 174 and tube assembly 182, the separated air spatial areas and the general concepts of the use of the core tubes 180 will be described. More specifically, and as shown in part in FIGS. 8 and 16, the filler pieces 172 of each of the core plates 160 abuts against an interior surface of the first and second housing halves 140, 142, respectively, of the exchanger housing 138. Such abutment positions are illustrated in FIG. 5 as positions 184 and 186. Correspondingly, and as shown with respect to the frame piece 168 in FIG. 10, the frame piece 168 can be connected to or otherwise sealed against a surface of the exchanger housing 138. Similarly, the frame piece 170, although not specifically shown in the drawings, can be made to connect to or otherwise seal against an opposing interior surface of the exchanger housing 138. These abutments form what may be characterized as relatively air tight seals.

At this time, it should also be stated that air tight seals are provided between the core tubes 180 and the apertures or cylinders 178 of the core support assemblies 174 into which the ends of the core tubes 180 are positioned. In this regard, it should be noted at this time that the preferred method of assembly of the core tubes 180 with the core support assemblies 174 is to "lay in" the core tubes 180 as the individual core supports 194 or 200 (described subsequently herein) are interlocked together. This method of assembly will facilitate appropriate fitting of the core tubes 180 into the cylinders 178 resulting from the interlocking coupling of the individual core supports 194 or 200 so as to form the core support assemblies 174. More specifically, the outer diameter of each of the core tubes 180 will be somewhat slightly larger than the inner diameter of each of the apertures or cylinders 178. With the core tubes 180 composed of plastic materials, the tubes 180 exhibit a certain amount of resiliency. Accordingly, the core support tubes 180 are inserted into the apertures or cylinders 178 in what may be characterized as a "compression fit." Without a need for any type of complex structure, and in accordance with the invention, this capability of having a compression fit between the core tubes 180 and apertures or cylinders 178 provides a relatively air tight seal. Accordingly, with these air tight seals, air from the fresh airstream 122 (which is to flow through the core tubes 180) will not "leak" into the area between the core support assemblies 174 around and outside of the core tubes 180.

With the sealing of the core plates 160 to the interior surfaces of the exchanger housing 138, and with the compression seals between the core tubes 180 and the core support assemblies 174, a set of what can be characterized as three spatial areas are formed within the interior of the housing 138 of the exchanger assembly 100. More specifically, one of the spatial areas can be characterized as a stale air area 188 as identified in FIG. 5. This stale air area 188 is formed between the opposing pair of core plates 160. Also, the stale air area 188 is open to the incoming stale air duct 148 and the outgoing stale air duct 152. It is therefore apparent that it is this area 188 through which the stale airstream 114 flows through the exchanger assembly 100. It is during the period of time that the stale airstream 114 is flowing through the stale air area 188 that the stale airstream 114 will also be flowing around the tube assembly 182. As described in subsequent paragraphs herein, it is this flow around the tube assembly 182 which will cause an energy exchange between the stale airstream 114 and the fresh airstream 122.

In addition to the stale air area 188, the relative structural configuration between the core plates 160 and the housing 138 also forms an incoming fresh air area 190 (FIG. 5). The incoming fresh air area 190 is formed within the housing 138 between the incoming fresh air duct 146 and the second core plate 164. A third area, characterized as the outgoing fresh air area 192, is formed between the first core plate 162 and the outgoing fresh air duct 150. In accordance with the foregoing, as the fresh airstream 122 enters the incoming fresh air duct 146, the airstream 122 will travel through the incoming fresh air area 190 and into the individual core tubes 180 of the tube assembly 182. This fresh airstream 122 will then exit the individual core tubes 180 and flow through the outgoing fresh air area 192 and into the outgoing fresh air duct 150. Accordingly, it is the fresh airstream 114 which flows through the individual core tubes 180. As previously described, the stale airstream 114 will enter the stale air area 188 through the incoming stale air duct 148. This stale airstream 114 will then flow around the core tubes 180, thereby exchanging energy between the stale airstream 114 and a fresh airstream 122. The stale airstream 114 will then be exhausted outwardly through the outgoing stale air duct 152.

Figure 21:
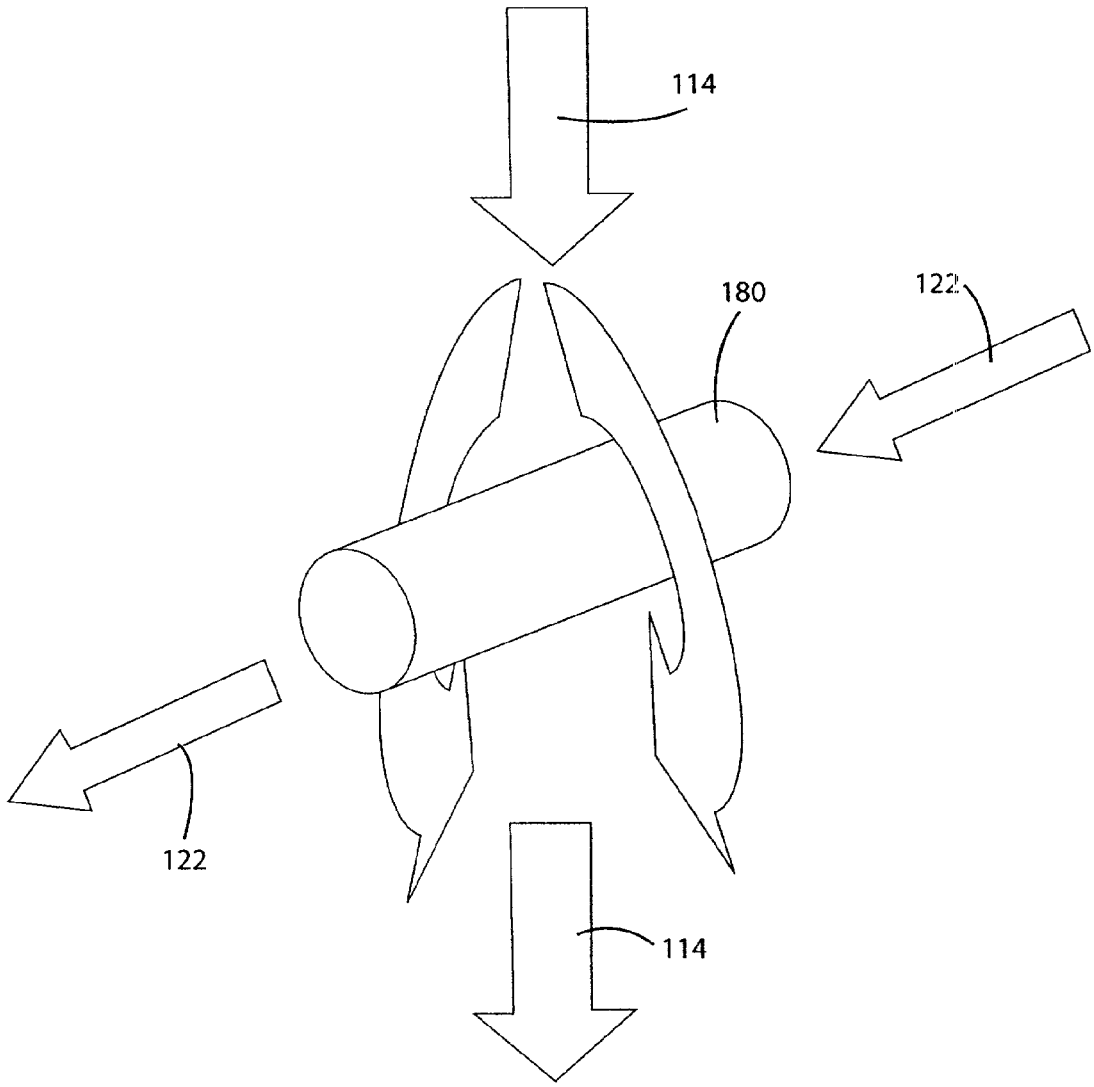
FIG. 21 is a partial, perspective view of one of the core tubes of the thermal energy exchanger in accordance with the invention, with FIG. 21 being partially schematic in that the drawing illustrates the exchange of thermal energy with respect to airstreams passing through and around the tubes.

The foregoing concepts of the "cross-coupling" of the stale airstream 114 and the fresh airstream 122 utilizing the core tubes 180, is diagrammatically illustrated in FIG. 21. As shown therein, the fresh airstream 122, consisting of fresh, outside air, flows into one end of each of the core tubes 180. Correspondingly, stale air 114 flows into the stale air area 188 and around the exterior of each of the core tubes 180. During this flow, and given the particular construction of the core tubes 180, energy is exchanged between the stale airstream 114 flowing around the core tubes 180, and the fresh airstream 122 flowing through the core tubes 180. For example, if the stale airstream 114 is warmer than the fresh airstream 122, heat will be removed from the stale airstream 114 and absorbed through the core tubes 180 into the fresh airstream 122. Accordingly, as the fresh airstream 122 exits each of the core tubes 180, the fresh airstream 122 will have been warmed and of a higher temperature. Correspondingly, after the warm, stale air in the form of the stale airstream 114 has passed around the core tubes 180 of the tube assembly 182, the stale airstream 114, having been somewhat cooled, is then exhausted to the outside. Conversely, if the stale airstream 114 is cooler than the fresh airstream 122, heat will be removed from the fresh airstream 122 flowing through the core tubes 180, and absorbed through the surfaces of the core tubes 180 into the stale airstream 114. Accordingly, as the fresh airstream 122 exits each of the core tubes 180, the fresh airstream 122 will have been cooled and will be of a relatively cooler temperature. Correspondingly, after the cool, stale air in the form of the stale airstream 114 has passed around the surfaces of the core tubes 180 of the tube assembly 182, the stale airstream 114 will have absorbed a certain amount of thermal energy and will then be exhausted to the outside. In either situation, the fresh airstream 122, after exiting the core tubes 180, is then guided through the appropriate plenums and duct work (previously described herein) into the interior 106.

Preferably, each of the core tubes 180 is of a tubular or cylindrical design. The composition of each of the core tubes 180 is such that each may comprise an ultra thin plastic composition, which conserves energy loss by transferring the thermal energy between the stale airstream 114 and the fresh airstream 122 flowing through the core tubes 180. In accordance with certain aspects of the invention, the core tubes 180 not only consist of a relatively thinner wall thickness than known tubular systems, but also provide for substantially greater surface area as the core tubes 180 are assembled into the core support assemblies 174. Also, the use of relatively thinner wall thicknesses results in core tubes 180 having relatively larger inner diameters and volume. These resultant larger air paths for the fresh airstream will assist in preventing the core tubes 180 from "freezing shut" during use in cold climates. Although it is possible that various types of plastic materials may be utilized for the core tubes 180, it is believed that it may be preferable for the core tubes 180 to be manufactured using a polypropylene composition.

The core support assemblies 174, and the components associated therewith, will now be described with respect to FIGS. 17-20, and primarily with respect to FIGS. 22-29. As earlier stated, each of the core plates 160 includes a core support assembly 174. The core support assembly 174 consists of a series of individual core supports. Two illustrative embodiments of core supports which may be utilized in accordance with the invention will be described herein. A first embodiment of an individual core support is illustrated as core support 194. The core support 194 is primarily shown in FIGS. 17-20, 22 and 23. A second illustrative embodiment of an individual core support in accordance with the invention is illustrated as core support 200. The core support 200 is shown in FIGS. 24-29. The core supports 194 and 200 are substantially identical in design and construction. However, the core support 194 includes, as primarily shown in FIGS. 22 and 23, a pair of opposing ends 196 having what can be characterized as beveled surfaces 198. The beveled surfaces 198 essentially are positioned so as to be at a 45° angle relative to a longitudinal axis extending along the elongated dimension of the core support 194. These beveled surfaces 198 can be utilized to facilitate sealing of the ends 196 to interior surfaces of the housing halves of the exchanger housing 138. That is, the use of the beveled surfaces 198 provides for a "flat" abutment between the interior surfaces of the housing 138 and the core support 194, since the core supports 194 are angularly positioned within the housing 138 relative to certain of the interior surfaces thereof. Additional details regarding the general structure of the core support 194 will be described in subsequent paragraphs herein.

The second illustrative embodiment of a core support in accordance with the invention, namely the core support 200, includes end assemblies 202 which can be characterized as being "squared off," in contrast to the beveled configuration of the ends 196 of the core support 194. Turning to more specific details regarding the core support 200, each of the supports 200, as assembled so as to form each core support assembly 174, is of a configuration identical to the others of the core supports 200. The principal function of the core supports 200, when assembled together to form the core support assemblies 174, is to appropriately secure the core tubes 180 to each of the core plates 160, with a configuration which efficiently provides for energy transfer between the stale airstream 114 flowing around the outer surfaces of the tubes 180, and the fresh airstream 122 flowing through the interiors of the core tubes 180.

Figure 24:
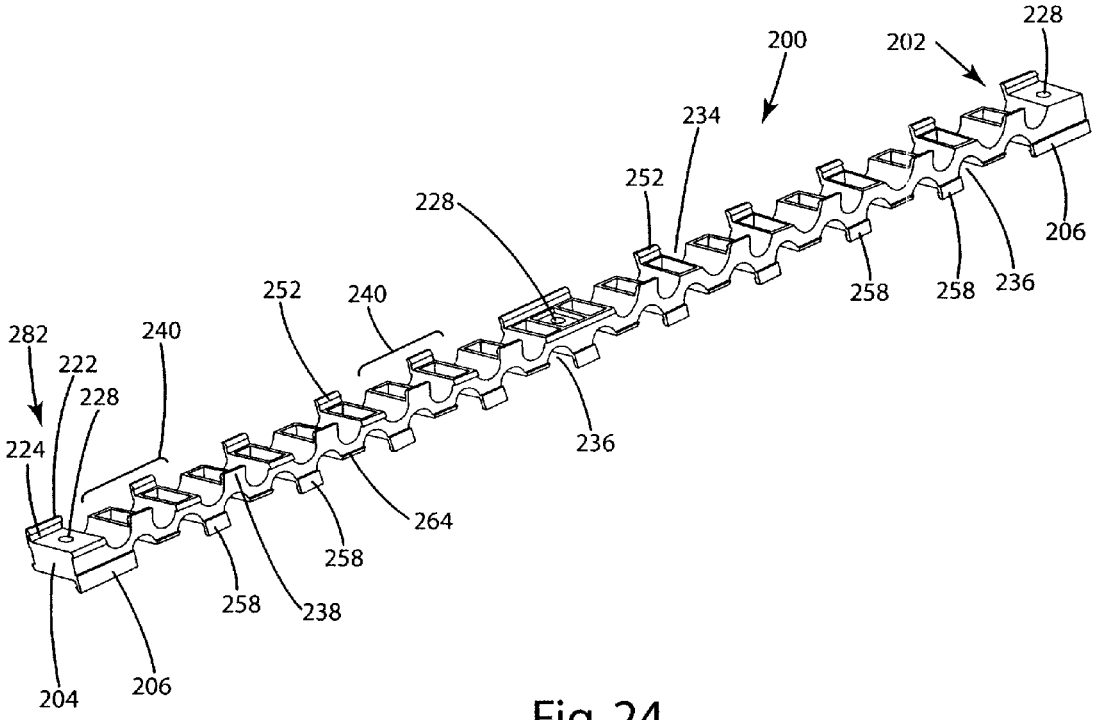
FIG. 24 is a perspective view of one of a second embodiment of core supports which may be utilized with the thermal energy exchanger in accordance with the invention.
Figure 25:
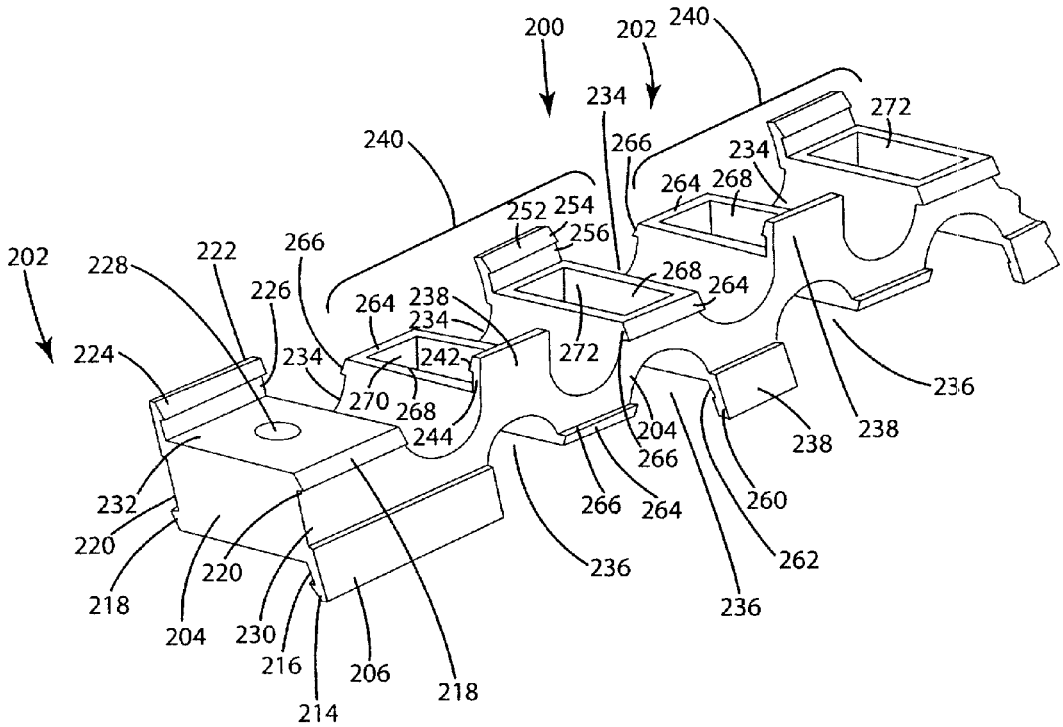
FIG. 25 is a perspective and enlarged view of one end of the core support shown in FIG. 24.
Figure 26:
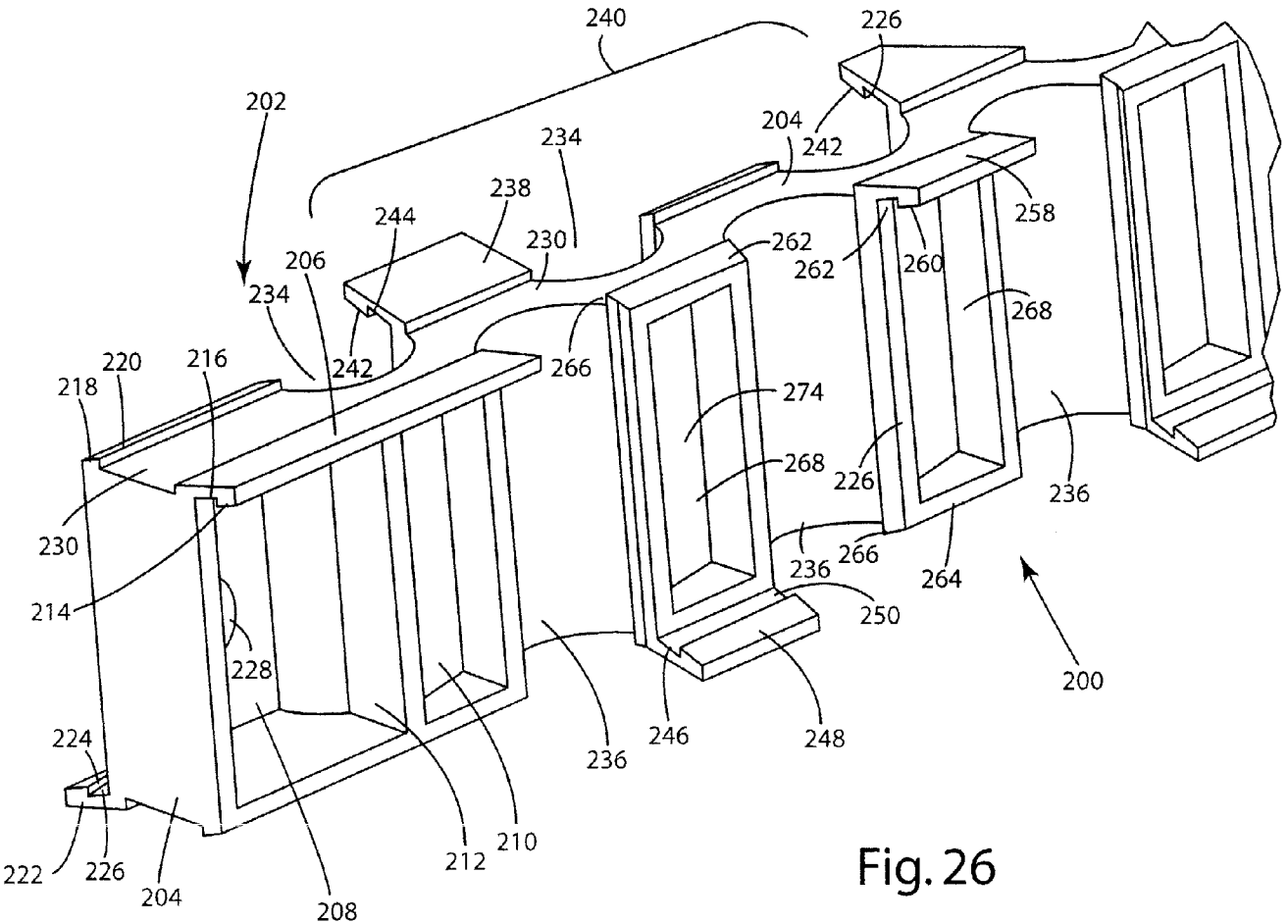
FIG. 26 is a perspective and enlarged view of the one end of the core support illustrated in FIG. 25, but with the core support of FIG. 26 rotated 90° relative to the view in FIG. 25.

Turning first to FIGS. 24, 25 and 26, each of the core supports 200 includes an elongated main body 204.

At opposing ends of each core support 200 (only one end of which is shown in FIGS. 25 and 26) is a configuration which can be characterized as an end assembly 202. The end assemblies 202 at the opposing ends of each core support 200 are identical. Each end assembly 202 includes a wide end bracket 206 which extends angularly outwardly from the main body 204. As particularly shown in FIGS. 25 and 26, the wide end bracket 206 is of a rectangular configuration (integral to the main body 204) and has a lip 214 formed along one surface of the bracket 206 and along an outer edge thereof. The lip 214 and the main body of the wide end bracket 206 form a slot 216 as again primarily shown in FIGS. 25 and 26. The wide end bracket 206 can be characterized as extending angularly outwardly from a surface side 230 of the main body 204. Extending outwardly from the same side 230 but on an opposing edge relative to the edge from which the wide end bracket 206 extends is an end flange 218. The end flange 218 has an elongated configuration and forms what can be characterized as a catch edge 220 between the flange 218 and the surface of the side 230. This configuration of the end flange 218 is primarily shown in FIG. 26.

Turning to FIG. 25, an additional side 232 of the main body 204 is shown as a top side with the orientation of the core support 200 shown in FIG. 25. The side 232 is essentially perpendicular to the side 230 previously described with respect to FIG. 26. As further shown in FIG. 25, the end assembly 202 further includes what could be characterized as a narrow end bracket 222 extending angularly from one edge of the side 232. The narrow end bracket 222 can be characterized as having a lip 224 formed along the outer edge of the end bracket 222. The lip 224 and one surface of the end bracket 222 form what can be characterized as a slot 226. As with other elements described with respect to the core support 200, the narrow end bracket 222 is preferably integral with the main body 204 and other components of the core support 200.

Still further, the end assembly 202 includes an aperture 228. As will be described subsequently herein, the aperture 228 formed in each end assembly 202 of each core support 200 is utilized to receive a threaded rod, bolt or similar structure for purposes of ensuring that the core supports 200 of each core support assembly 174 remain tightly secured to each other. Also, these threaded rods or bolts can be utilized to secure each core support assembly 174 to the exchanger housing 138. Further, the use of the threaded rods or bolts help to ensure that appropriate air tight seals are provided around the core tubes 180 when they are inserted into the core support assemblies 174. That is, pressure will be applied to the interconnected core supports 200 of each core support assembly 174 when the threaded rods or bolts are tightened together through the use of nuts or other appropriate connecting means. Further, however, it should be noted that the use of the threaded rods or bolts may be considered optional and is somewhat secondary to the principal concepts of the invention. That is, appropriate air tight sealing between the individual core supports, and the air tight sealing provided by a compression fit between the core supports and core tubes may be sufficient without the need of the threaded rods or bolts. As shown in FIG. 26, the end aperture 228 opens into what can be characterized as a wide end chamber 208. The end assembly 202 also includes what may be characterized as a narrow end chamber 210. The wide end chamber 208 and narrow end chamber 210 are separated by a web 212. The chambers 208, 210 are formed as part of the molding process for the preferably plastic core support 200. The fact that the chambers 208, 210 are hollow reduces the weight of each core support 200 and also reduces the amount of plastic mold required for construction of the core support 200.

The remaining portions of the core support 200 will now be described, primarily with respect to FIGS. 25 and 26. Turning thereto, and although the core support 200 has an integral configuration, the support 200 can be characterized as having a series of identical sections, referred to herein as coupling sections 240. Subsequent paragraphs herein will describe the elements of one of the coupling sections 240. However, it should be understood that the coupling section 240 is repeated along the elongated length of the core support 200, so as to provide for a core support 200 of desired length. Also, for purposes of description, and with reference to FIG. 25, the core support 200 will be characterized as having a top portion facing upwardly in the view of FIG. 25, and a bottom side facing downwardly in the view of FIG. 25.

With these reference directions, each coupling section 240 includes a set of four cylinder halves. On the top side of the coupling section 240 are a pair of first cylinder halves 234. Each of these cylinder halves 234 provides half of the inner surface of the cylinders within which the core tubes 180 will be received. On the bottom side of each coupling section 240 are a pair of second cylinder halves 236. The cylinder halves 234, 236 alternate in position lengthwise along the core support 200.

With further reference to FIGS. 25 and 26, each coupling section 240 includes a first bracket 238 which extends angularly upwardly as shown in FIG. 25. The first bracket 238 can be characterized as having a lip 242. The lip 242 and the first bracket 238 form a slot 244, best seen in FIG. 26. Correspondingly, the coupling section 240 also includes a second bracket 246, shown in FIG. 26 but hidden from view in FIG. 25. The second bracket 246 has a configuration substantially identical to the first bracket 238. That is, the second bracket 246 includes a lip 248 which forms, with the main body of the second bracket 246, a slot 250.

Still further, each coupling section 240 includes a third bracket 252 angled outwardly and upwardly as viewed in FIG. 25. The third bracket 252 is hidden from view in FIG. 26. In addition to the foregoing, each coupling section 240 also includes a fourth bracket 258. The fourth bracket 258 is illustrated in both FIGS. 25 and 26. The fourth bracket 258 is substantially identical to the other brackets 238, 246 and 252, and includes a lip 260 which forms a slot 262 with the main body of the fourth bracket 258. In the view of FIG. 25, it is apparent that the first bracket 238 is located on the same side of the core support 200 as is the fourth bracket 258. However, the first bracket 238 faces upwardly, while the fourth bracket 258 faces downwardly. Correspondingly, the second bracket 246 (shown in FIG. 26) and the third bracket 252 (shown in FIG. 25) are also both on the same side of the coupling section 240. In the view of FIG. 25, the third bracket 252 extends upwardly. Although not shown in FIG. 25, the second bracket 246 would be extending downwardly with the core support 200 in the orientation shown in FIG. 25. As apparent from the drawings, and viewing elements of the core support 200 as positioned along the elongated length of the core support 200, the sequence of brackets would be the first bracket 238, the second bracket 236, the third bracket 252, and the fourth bracket 258.

In addition to the brackets, each coupling section 240 also includes a series of flanges 264. As shown in the drawings, the flanges 264 are positioned directly across from each of the brackets 238, 246, 252 and 258. As also shown in the drawings, each flange 264 includes a catch edge 266. Still further, and as primarily shown in both FIG. 25 and FIG. 26, each coupling section 240 includes a series of hollow chambers 268. The chambers 268 are positioned intermediate the flanges 264 and the brackets 238, 246, 252 and 258. As shown in FIG. 25, the chambers 268 include a first chamber 270 and a second chamber 272, with the chambers open upwardly in the view of FIG. 25. Correspondingly, and in alternating positions relative to the chambers 270, 272, FIG. 26 illustrates a third chamber 274 and a fourth chamber 276.

The foregoing comprise the individual elements of each of the coupling sections 240. As previously described, the coupling sections 240 are integral with each other and extend lengthwise along the longitudinal axis of the core support 200.

Figure 27:
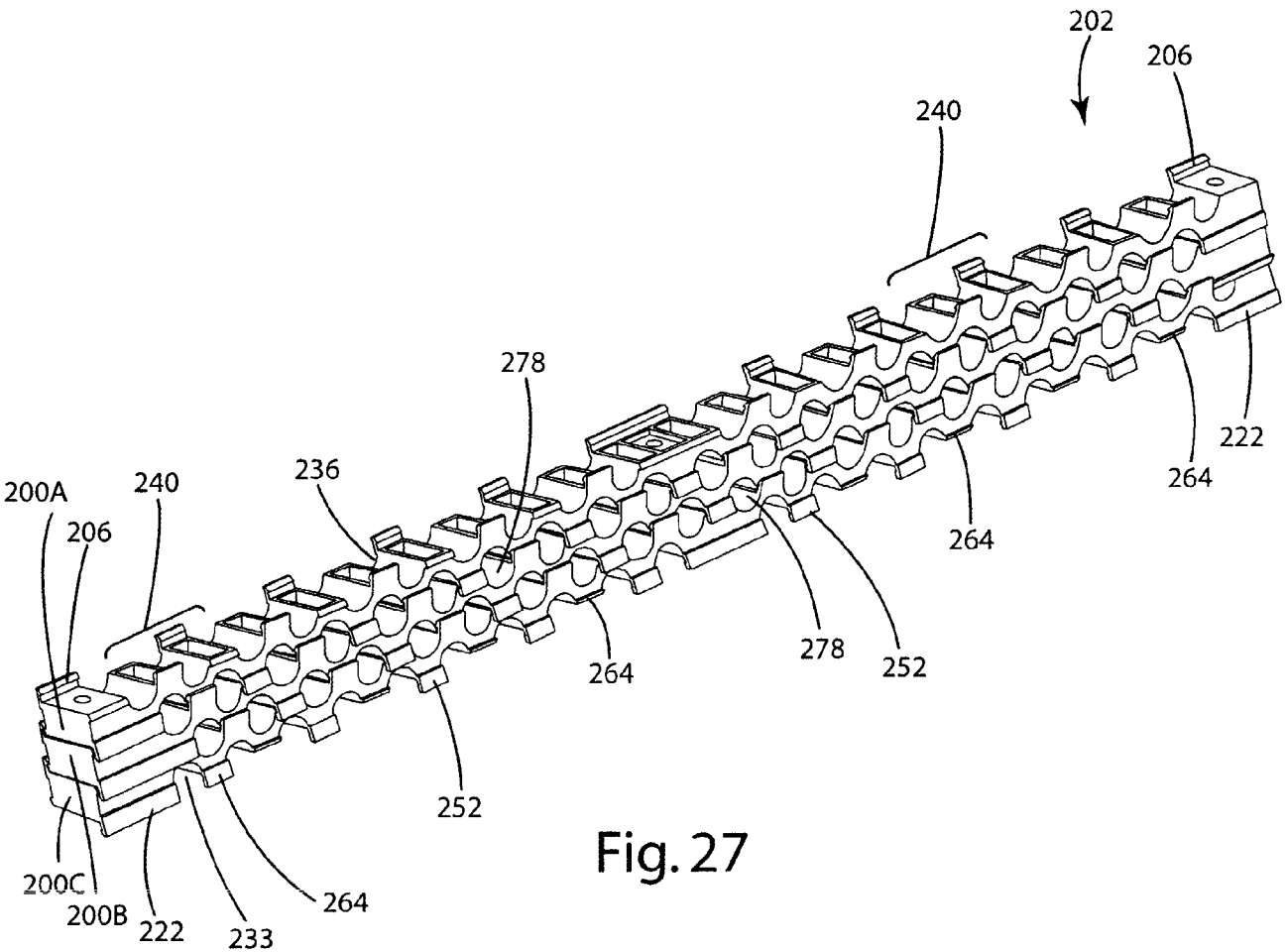
FIG. 27 is a perspective view illustrating the coupling together of three of the core supports illustrated in FIGS. 24, 25 and 26.
Figure 28:
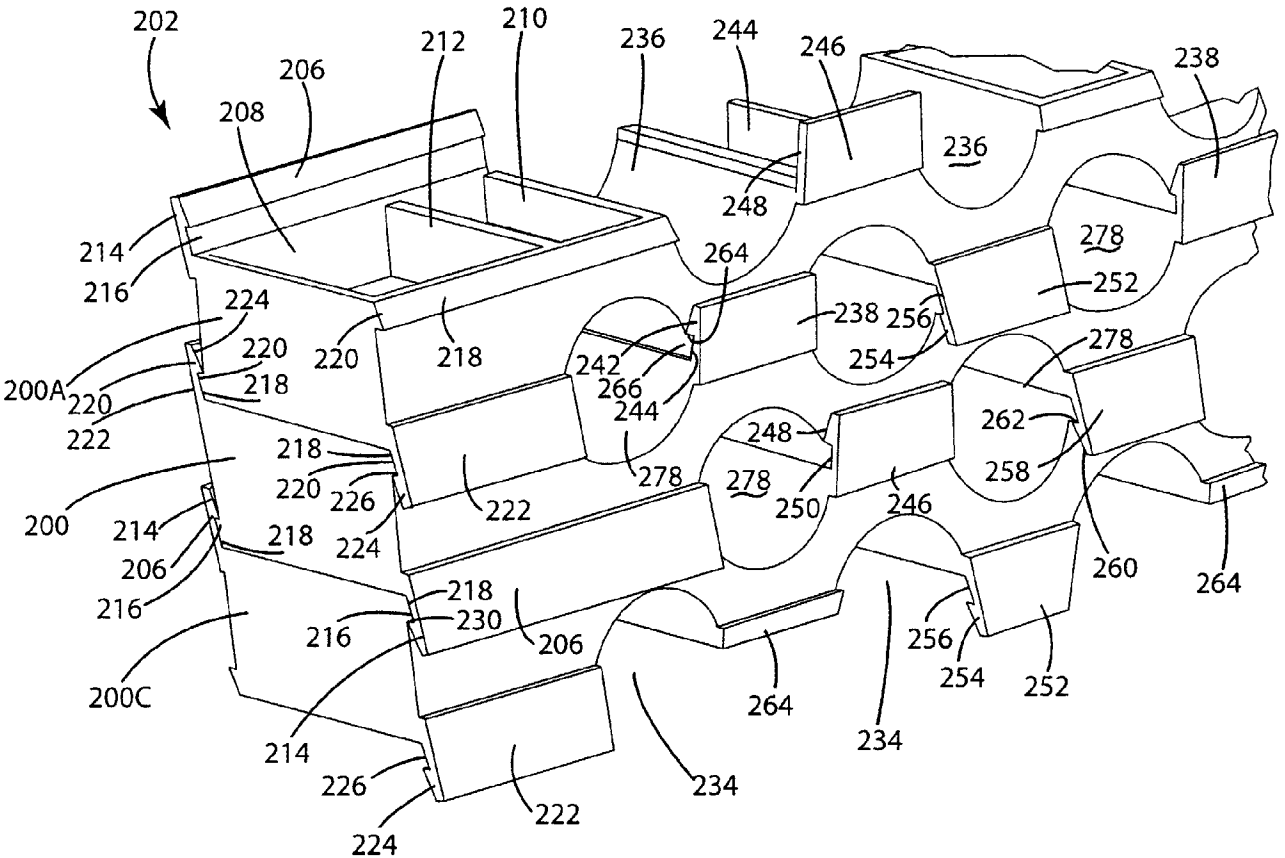
FIG. 28 is a perspective and enlarged view of one end of the core supports shown coupled together in FIG. 27, and showing relatively greater detail with respect to how the core supports are interlocked together.
Figure 29:
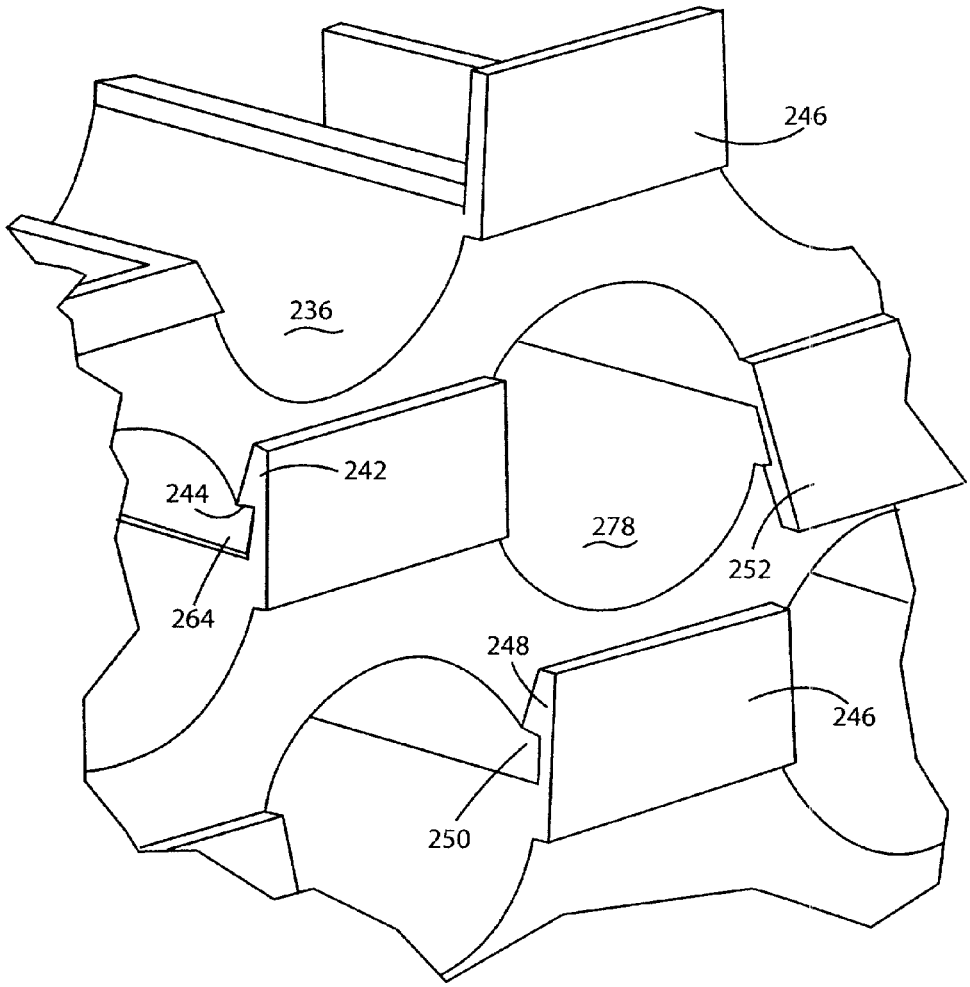
FIG. 29 is a perspective and enlarged view of a portion of the interconnected core supports illustrated in FIG. 28.

The coupling together of the individual core supports 200 so as to form a core support assembly 174 will now be described primarily with respect to FIGS. 27, 28 and 29. As illustrated in these drawings, three of the core supports 200 are shown as being coupled and interlocked together. When they are coupled together, the core supports 200 form cylinders 278 into which the core tubes 180 have been laid in during assembly, so as to form the tube assembly 182. For purposes of the description, the three core supports 200 illustrated in FIGS. 27, 28 and 29 are separately referred to as core supports 200A, 200B and 200C. As shown in FIGS. 27 and 28, the core support 200A is positioned so that its wide end bracket 206 faces upwardly (as viewed in the illustrations), and the opposing narrow end bracket 222 faces downwardly. In contrast, core support 200B is positioned below core support 200A and is essentially turned "upside down" relative to core support 200A. Accordingly, for core support 200B, the wide end bracket 206 faces downwardly and is on an opposing side of the wide end bracket 206 of core support 200A. Similarly, the narrow end bracket 222 of the core support 200B faces upwardly on an opposing side of the narrow end bracket 222 of core support 200A. In this position, it is shown that one of the flanges 218 and corresponding catch edge 220 of the core support 200A is captured within the slot 226 formed with the narrow end bracket 222 and lip 224 of the core support 200B. Similarly, at the forward portion of the core support 200A as viewed in FIG. 28, the narrow end bracket 222, corresponding lip 224 and corresponding slot 226 are positioned so as to receive the catch edge 220 of the flange 218 of core support 200B.

Moving to the coupling of the end assemblies 202 of the core support 200B and core support 200C, and again with reference to FIGS. 27, 28 and 29, the wide end bracket 206 of the core support 200B faces downwardly and the lip 214 thereof and corresponding slot 216 are utilized to capture the catch edge 220 of a flange 218 of core support 200C. At this time, it should be noted that the orientation of the core support 200C is the same as the orientation of the core support 200A. That is, core supports 200A and 200C are vertically "reversed" from the orientation of the core support 200B. Still further, and although only partially shown in FIG. 28, the wide end bracket 206 of the lower core support 200C (positioned at the rear of the core support 200C as viewed in FIG. 28) includes a slot 216 which is utilized to capture a lower flange 218 and corresponding catch edge 220 of the intermediate core support 200B. The foregoing describes certain interconnections of the end assemblies 202 of an example coupling of the three core supports 200A, 200B and 200C.

The coupling sections 240 of each of the core supports 200A, 200B and 200C have similar coupling interconnections. Again, with reference to FIGS. 28, 29 and 30, and with reference to an individual coupling section 240, the first bracket 238 of the intermediate core support 200B includes a lip 242 and corresponding slot 244 which are utilized to capture a flange 264 and catch edge 266 of the upper core support 200A. Correspondingly, and again with reference to FIG. 28, the third bracket 252 of the upper core support 200A includes a lip 254 and corresponding slot 256 which extends downwardly and is utilized to capture a flange 264 and catch edge 266 of the intermediate core support 200B. These represent the couplings shown in FIG. 28 between the upper core support 200A and intermediate core support 200B with respect to a given coupling section 240.

With respect to the couplings between the intermediate core support 200B and lower core support 200C, FIGS. 27, 28 and 29 illustrate a second bracket 246 of the lower core support 200C extending upwardly. The second bracket 246 includes a lip 248 and slot 250 which capture a flange 264 and catch edge 266 of the intermediate core support 200B. Correspondingly, FIG. 28 also shows a fourth bracket 258 of the intermediate core support 200B extending downwardly. This fourth bracket 258 includes a lip 260 and slot 262 which are utilized to capture a flange 264 and catch edge 266 of the lower core support 200C. These two foregoing couplings provide for the coupling interconnections between the intermediate core support 200B and lower core support 200C. Of course, it will be apparent from the foregoing description that similar coupling interconnections are made between brackets and flanges of the core supports 200B and 200C on the sides of the core supports 200 opposing those sides which are visible in FIGS. 27, 28 and 29.

Still further, and as previously described herein, the coupling interconnections of the core supports 200 form the cylinders 278 into which the core tubes 180 are received. Also in accordance with certain aspects of the invention, the inner-diameter of the cylinders 278 is slightly smaller than the outer diameter of the core tubes 180. Accordingly, when the tubes 180 are received within the cylinders 278, a "compression fit" occurs. This compression fit facilitates sealing of the core tubes 180 with the core assemblies 174, so as to prevent air leakage between spatial areas of the thermal energy exchanger assembly 100.

Figure 22:
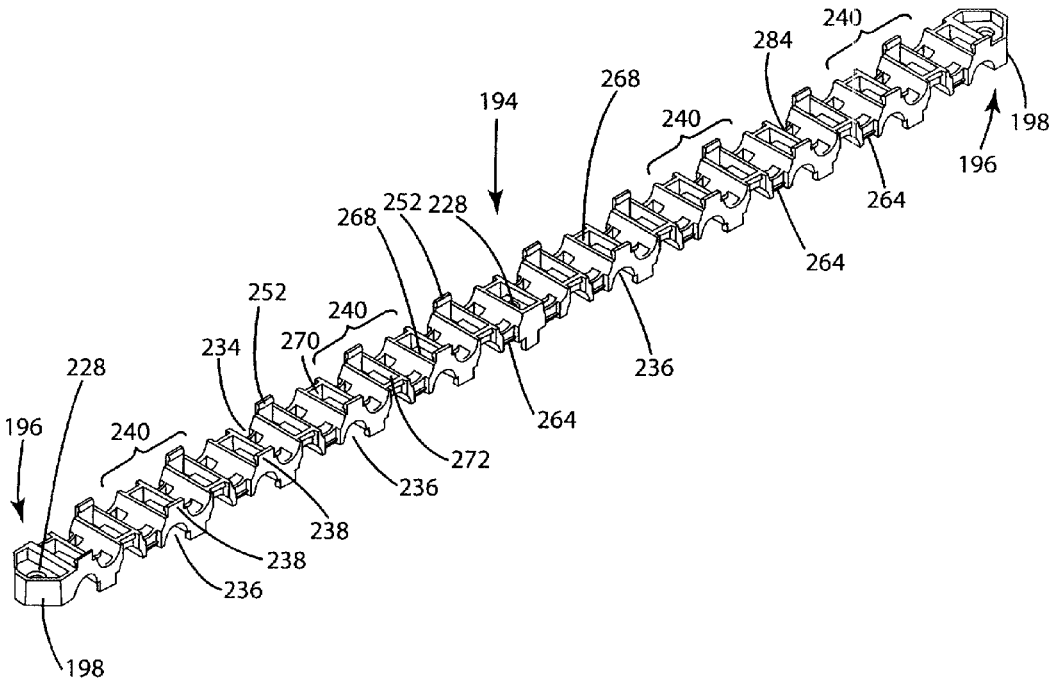
FIG. 22 is a perspective view of one embodiment of one of the core supports of the core plate assemblies of the thermal energy exchanger in accordance with the invention.
Figure 23:
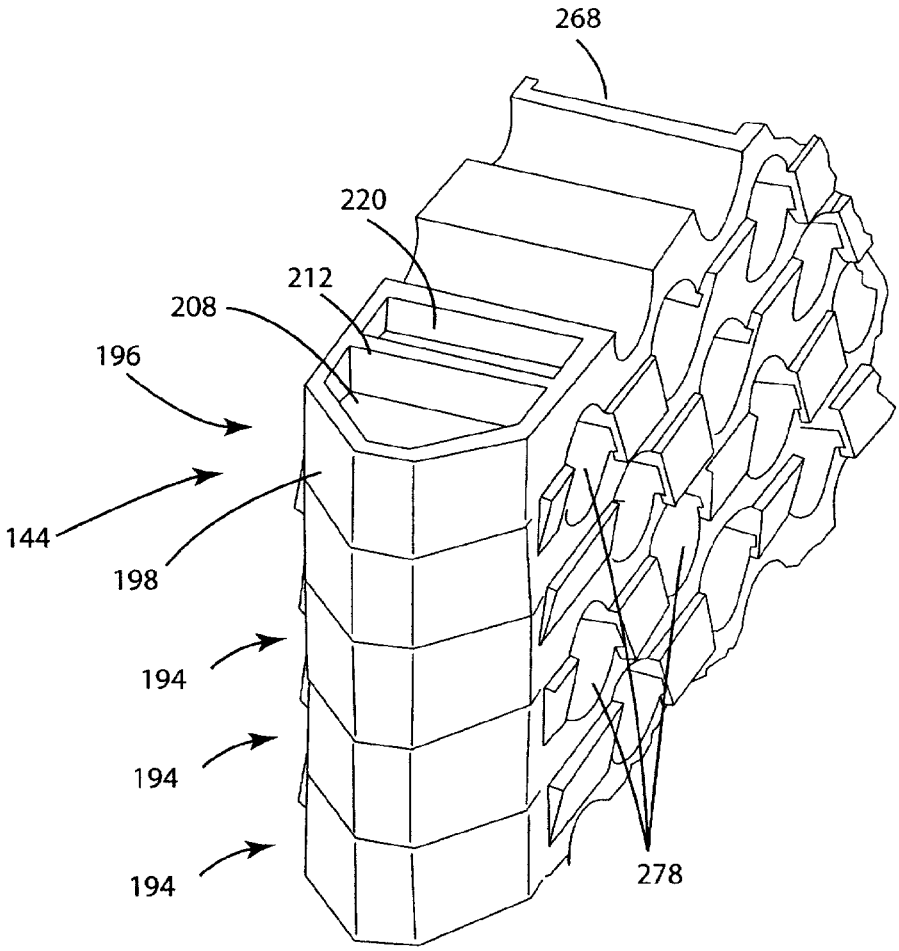
FIG. 23 is a perspective view of a portion of one of the core support assemblies formed utilizing a series of the core supports shown in FIG. 22.

The specific core supports 200 illustrate one embodiment of core supports that may be utilized in accordance with the invention. Another embodiment of core supports which may be utilized in accordance with the invention, and as previously briefly described herein, are core supports 194 illustrated in FIGS. 22 and 23. As also previously described herein, the primary distinction between the core supports 194 and core supports 200 reside in the differences in the end assemblies 196 and 202. As shown in FIGS. 22 and 23, the end assemblies 196 of the core supports 194 comprise beveled surfaces 198. This is in contrast to the "squared off" surfaces of the end assemblies 202 associated with the core supports 200. However, the coupling sections 240 of the core supports 200 as previously described herein correspond to structure and elements of the core support 194 intermediate the end assemblies 196. Accordingly, FIGS. 22 and 23 utilize numerical references identical to those used in FIGS. 24-29 for elements of the core supports 194 which are functionally and structurally identical to like numbered elements of the core supports 200. In view of the foregoing description, the specific elements of the core supports 194 will not be described herein, since they correspond to the description previously set forth herein for the core supports 200.

As apparent from the foregoing, the various structural elements of the core supports 200 can be sized and configured so that the coupling together of the core supports 200 provide for relatively air tight seals. However, in certain instances, it may be desired to facilitate the air tight sealing and compression fit of the core tubes 180 within the cylinders 278 through additional means. An example of such additional means is illustrated in substantial part in FIGS. 16, 17, 19 and 20. As previously described herein, the end assemblies 202 of the core supports 200 may include apertures 228. Also, if desired, additional apertures 228 may extend through one or more of the coupling sections 240. For example, and with respect to the alternative core support 194, FIG. 22 illustrates an aperture 228 extending through the core support 194 substantially equidistant apart from each of the end assemblies 198. These apertures 228 can, if desired, be threaded (or frame pieces at the upper and lower portions of core support assemblies 174 may be threaded) and receive threaded or similar rods 280. The rods 280 may extend through the entire sets of apertures 228 within a set of core supports 200 or 194 which form a core support assembly 174. The threaded rods 180 may have rod heads positioned at one end of the rods 280, and may be secured to the core support assemblies at their other ends through the use of nuts 282 or the like. Tightening these rods 280 after they have been received through the apertures 228 will readily facilitate tightening together of the individual core supports 200 or 194, and will also provide additional compression forces on the core tubes 180 within the cylinders 278.

A thermal energy exchanger assembly 100 has now been described in accordance with the invention, with alternative embodiments for the core supports (i.e. core supports 194 and core supports 200). Various concepts are embodied within thermal energy exchanger assemblies in accordance with various aspects of the invention. A number of these advantageous concepts have been previously described herein. For example, with the designs of the tubes and core plates as shown herein, assembly speed can be rapidly increased compared to other types of prior art exchanger assemblies. Employing plastic materials for components of the energy exchanger assembly significantly reduces the need for defrosting functions, in view of the significant reduction in "freeze-up." Further, with metal housings, units are often subjected to rust, eventually resulting in the mixing of the airstreams and ultimate failure of the assemblies. With plastic materials, longevity of the thermal energy exchanger increases, due to the elimination of components subject to rust.

Further, with the design of the tube assembly 182 described herein, a substantial amount of spatial volume is provided for energy exchange. In addition, in view of the core tubes 180 being substantially separated from each other, and only required to be supported at their ends, a substantial amount of surface area is provided which separates the fresh airstreams from the stale airstreams. The greater the surface area of the material which separates the airstreams, the higher will be the flow rate of thermal energy between the airstreams. Still further, this increase in space and openings also facilitates reduction of freeze-up. Put another way, the thin-walled construction of the core tubes provides for a larger inner diameter for the tubes 180, and more space around the exterior of the tubes 180. These features result in a significant reduction in static pressures and airstream flow resistance, both within and outside the tubes 180. Again, this reduces freeze-up and the probability of the need for fans or the like.

Still further, the thermal energy exchanger assemblies in accordance with the invention may be operated as "passive" assemblies. That is, these assemblies require no moving parts, such as fans or the like. This occurs because of the efficiency of thermal energy transfer between the airstreams. This capability of not requiring fans or similar components also reduces the possibly of rust or other type of metal wear. In addition, and as described herein, air filters may be utilized with the thermal energy exchanger assemblies in accordance with the invention. The designs of the tubes and the use of air filters can improve relative cleanliness. That is, known plate core designs accumulate dust and dirt particles which can eventually plug up a core and reduce exchange efficiency and airflow. Such known thermal energy exchangers are then relatively difficult to clean, because the cleaning requires the disassembly of the unit periodically, so as to maintain efficiency.

In view of the lack of moving parts, thermal energy exchanger assemblies in accordance with certain aspects of the invention may be of relatively low cost. Also, the core tubes 180 may have relatively thin wall plastic materials which utilize "film heat transfer" technologies. Such tube designs have advantages over other cores on the market, because they provide for a greater surface area than current plate technology. Also, due to the internal diameter of the tubes 180, they will reject "freeze-up" in cold weather, which again may require defrosting cycles. Still further, with the tubes 180 supported so as to provide for relatively additional and larger spaces between and around the tubes, freeze-up is again significantly reduced. These features again reduce the probability of a need for a fan.

With respect to the core plates 160, it is advantageous that the designs in accordance with certain aspects of the invention essentially comprise preformed inserts, along for tubes to be quickly "laid in" and sealed with compression. Further, such a design will work with current plastic tubes, and with enthalpic tubes known to be utilized for energy recovery ventilators, as well as metal tubes such as copper or aluminum, without requiring design changes to the overall unit.

As also previously described herein, the core plate assemblies 174, comprising the core supports 194 or 200, can essentially be constructed entirely of plastic materials. For example, the core supports 194 or core supports 200 may be composed of ABS.

It will be apparent to those skilled in the pertinent arts that other embodiments of thermal energy exchanger assemblies in accordance with the invention may be designed. That is, the principles of thermal energy exchanger assemblies in accordance with the invention are not limited to the specific embodiments described herein. Accordingly, it will be apparent to those skilled in the arts that modifications and other variations of the above-described illustrative embodiments of the invention may be effected without departing from the spirit and scope of the novel concepts of the invention.

The invention claimed is:

1. A thermal energy exchanger assembly adapted for use with building interiors for exchange of energy between fresh air and state air, said energy exchanger comprising:

an exchanger housing;

fresh airstream incoming means coupled to said exchanger housing for receiving an incoming fresh airstream and guiding said incoming fresh airstream to said exchanger housing;

stale airstream incoming means coupled to said exchanger housing for receiving an incoming fresh airstream and guiding said incoming fresh airstream to said exchanger housing;

a pair of core support assemblies, comprising a first core support assembly and a second core support assembly, each of said core support assemblies comprising a series of core supports coupled together and defining a series of core tube apertures therein;

at least one tube assembly extending between said pair of core support assemblies, and comprising a plurality of core tubes;

each of said plurality of core tubes having first and second ends, with said first ends of said core tubes received within said series of apertures of said first core support assembly, and said second ends of said core tubes received within said series of apertures of said second core support assembly;

said incoming fresh airstream flows into said plurality of core tubes, and said incoming stale airstream flows between and around said plurality of said core tubes;

said core tubes are sized, structured and manufactured of plastic materials so that an exchange of thermal energy occurs between said incoming fresh airstreams within said core tubes and said incoming stale airstreams flowing between and around said core tubes;

each of said core supports comprises a series of coupling sections, with each coupling section being identical to each of the others of said coupling sections, and formed along an elongated portion of said core support, and with each of said core supports being characterized as having a top side and a bottom side, each coupling section comprising:

a plurality of cylinder halves, with a pair of first cylinder halves located on said top side of said coupling section, and with each of said first cylinder halves providing half of an inner surface of said apertures within which said core tubes will be received;

said plurality of cylinder halves further comprising a pair of second cylinder halves located on said bottom side of said coupling section, with said first cylinder halves alternating in position lengthwise along said core support with said second cylinder halves;

a first bracket extending angularly upwardly, with said first bracket having a lip so as to form a slot;

a second bracket having a configuration substantially identical to said first bracket, with a lip forming a slot with a main body of said second bracket;

a third bracket angled outwardly and upwardly;

a fourth bracket substantially identical to each of said first, second and third brackets, with a lip forming a slot with said main body of said fourth bracket;

said first bracket being located on the same side of said core support as is said fourth bracket, with said first bracket facing upwardly, and said fourth bracket facing downwardly;

said second bracket and said third bracket also being located on the same side of said coupling section with said third bracket extending upwardly and said second bracket extending downwardly;

a series of flanges positioned directly across from each of said first, second, third and fourth brackets, with each of said flanges having a catch edge;

a series of hollow chambers positioned intermediate said flanges and said first, second, third and fourth brackets, with said chambers having a first chamber and a second chamber, and with said first and said second chambers opening upwardly; and said hollow chambers further comprise a third chamber and a fourth chamber, with said third and fourth chambers positioned in alternating positions relative to said first and said second chambers.

2. A thermal energy exchanger assembly in accordance with claim 1, characterized in that:

when three of said core supports are coupled and interlocked together, said core supports form said apertures into which said core tubes are laid in during assembly, so as to form said tube assembly, with said three core supports characterized as comprising first, second and third core supports;

said first core support is positioned so that a wide end bracket of said core support faces upwardly, and an opposing narrow end bracket of said core support faces downwardly;

said second core support is positioned below said first core support and is turned essentially "upside down" relative to said first core support;

with said second core support being in a position upside down relative to said first core support, a wide end bracket of said second core support faces downwardly and is on an opposing side of said wide end bracket of said first core support;

a narrow end bracket of said second core support faces upwardly on an opposing side of said narrow end bracket of said first core support;

one of said flanges and a corresponding catch edge of said flange of said first core support is captured within a slot formed within said narrow end bracket and lip of said second core support; and at a forward portion of said first core support, said narrow end bracket, corresponding lip and corresponding slot are positioned so as to receive the catch edge of said flange of said second core support.

3. A thermal energy exchanger assembly in accordance with claim 2, characterized in that said assembly of said first, second and third core supports further comprises:

said wide end bracket of said second core support faces downwardly and said lip thereof and corresponding slot are utilized to capture said catch edge of a flange of said second core support;

an orientation of said third core support is the same as the orientation of said first core support, so that said first and third core supports are vertically "reversed" from the orientation of said second core support; and said wide end bracket of said third core support includes a slot which is utilized to capture a lower flange and corresponding catch edge of said second core support.

4. A thermal energy exchanger assembly in accordance with claim 3, characterized in that said coupling sections of said first, second and third core supports are assembled together as follows:

with respect to an individual coupling section, said first bracket of said second core support includes a lip and corresponding slot utilized to capture a flange and catch edge of said first core support;

said third bracket of said first core support includes a lip and corresponding slot which extend downwardly and are utilized to capture a flange and catch edge of said second core support;

a second bracket of said third core support extends upwardly, and includes a lip and slot which capture a flange and catch edge of said second core support; and a fourth bracket of said second core support extends downwardly, and includes a slot which captures a flange and catch edge of said third core support.

* * * * *